US006402311B1

(12) United States Patent
Inoue et al.

(10) Patent No.: US 6,402,311 B1
(45) Date of Patent: Jun. 11, 2002

(54) INK JET RECORDING HEAD, INK JET RECORDING HEAD CARTRIDGE AND INK JET RECORDING APPARATUS

(75) Inventors: Ryoji Inoue, Kawasaki; Masanori Takenouchi, Yokohama; Akio Saito, Machida; Shin Ishimatsu, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/641,974

(22) Filed: Aug. 21, 2000

(30) Foreign Application Priority Data

Aug. 23, 1999 (JP) ..... 11-235756

(51) Int. Cl.[7] ..... B41J 2/19
(52) U.S. Cl. ..... 347/92; 347/65
(58) Field of Search ..... 347/56, 61, 63, 347/65, 93, 92

(56) References Cited

U.S. PATENT DOCUMENTS 4,752,787 A 6/1988 Matsumoto et al. ..... 346/140
5,808,643 A * 9/1998 Tracy et al. ..... 347/92
6,000,777 A 12/1999 Nozawa et al. ..... 347/20
6,003,986 A * 12/1999 Keefe ..... 347/92
6,084,616 A * 7/2000 Nakata et al. ..... 347/65

FOREIGN PATENT DOCUMENTS

| | | |
|---|---|---|
| EP | 0816089 | 1/1998 |
| EP | 0842778 | 5/1998 |
| EP | 0888890 | 1/1999 |
| EP | 1078749 | 2/2001 |
| JP | 55-132259 | 10/1980 |

* cited by examiner

*Primary Examiner*—Anh T. N. Vo
(74) *Attorney, Agent, or Firm*—Fitzpatrick, Cella, Harper & Scinto

(57) ABSTRACT

An ink jet recording head comprising a plurality of discharge ports for discharging ink droplets, a plurality of ink flow paths communicated with the respective discharge ports, a common liquid chamber communicated with said ink flow paths and adapted to hold ink to be introduced into said ink flow paths, electro-thermal converting portions disposed in said ink flow paths and adapted to generate heat for bubbling the ink, and bubble trapping portions disposed at communicating portion between said ink flow paths and said common liquid chamber.

15 Claims, 17 Drawing Sheets

INK JET RECORDING HEAD, INK JET RECORDING HEAD CARTRIDGE AND INK JET RECORDING APPARATUS

BACKGROUND OF THE INVENTION

1. Field of the Invention

The present invention relates to an ink jet recording head in which a bubble is generated by heating ink by means of an electrothermal converting element and the ink is discharged by pressure upon generation of the bubble, an ink jet recording head cartridge in which such an ink jet recording head and a liquid container for supplying liquid to the ink jet recording head are integrally formed, and an ink jet recording apparatus to which such an ink jet recording head cartridge is mounted.

2. Related Background Art

Almost all of ink jet recording apparatuses have been used as a printing apparatus in an image forming apparatus such as a printer, a facsimile, a word processor, a copying machine and the like. Among them, an ink jet recording apparatus of type in which thermal energy is used as energy utilized for discharging the ink and the bubble is generated in the ink by the thermal energy and the ink is discharged by change in volume upon generation of the bubble has recently been spread.

Further, as another application of the ink jet recording apparatus of this kind, an ink jet print device for printing a predetermined pattern, a design or a composite image on cloth has recently been known. An ink jet recording head used in the above-mentioned ink jet recording heads utilizes electrothermal converting elements (referred to also as "heaters" hereinafter) as means for generating the energy, and, in many cases, one heater corresponds to one discharge port.

To the contrary, an ink jet recording head in which a plurality of heaters are provided with respect to each of discharge ports for the following reasons has also been known.

That is to say, firstly, in order to extend the service life of the ink jet recording head, the plurality of heaters are driven alternately or the heater to be driven is appropriately switched. Secondly, by changing an ink discharged amount by selecting the heater or heaters to be driven, the change in ink discharged amount is realized.

As a concrete construction of the latter, an arrangement in which a plurality of heaters are disposed in each ink flow path (nozzle) communicated with a corresponding ink discharge port of the ink jet recording head along an ink discharging direction so that the ink discharged amount is changed due to the difference in distance between the driven heater and the associated discharge port by selecting the heater to be driven (heated) or the ink discharged amount is changed by changing the number of heaters to be driven has been known.

Further, as another construction, for example, as disclosed in Japanese Patent Application Laid-open No. 55-132259, an arrangement in which a plurality of heaters having different surface areas are disposed in each ink flow path so that the ink discharged amount is changed by similarly changing the heater to be driven or changing the number of heaters to be driven is also known.

An example of such an ink jet recording head is shown in FIG. 17 as a sectional view. As shown in FIG. 17, in this ink jet recording head, two heaters 6002, 6003 having different dimensions and different distances from a discharge port

6004 are disposed in a nozzle 6001 for communicating the ink discharge port 6004 with a common liquid chamber 6005 for containing ink to be supplied to a plurality of nozzles 6001 so that the amount of ink to be discharged can be changed by driving one or both of the heaters 6002, 6003.

Although the above-mentioned ink jet recording head having the plurality of heaters disposed in the respective nozzle has a purpose for realizing high speed and high accurate printing in response to various images by changing the ink discharged amount, there arose the following problem to achieve this purpose.

Nowadays, high density arrangement of the nozzle has been requested to achieve high accurate and finer printing, and, to this end, a width of each nozzle must be narrower. On the other hand, the heaters having large sizes must be used in order to widen the variable range of the ink discharged amount. Accordingly, when the size of the heater tries to be increased in the narrow nozzle, a longitudinal dimension (length) of each heater must be increased along the longitudinal direction of the nozzle, with the result that a length of the nozzle must be increased. If the length of the nozzle is increased, flow resistance of the nozzle will be increased, with the result that a time (re-fill time) for restoring meniscus retarded within the nozzle after the ink discharging to the vicinity of the discharge port again is delayed, thereby reducing the recording speed.

As a method for shortening the ink re-fill time to hasten the recording speed, a method in which the length of the nozzle 6001 is shortened, and, as shown in FIG. 18, a method in which a cross-sectional area of the nozzle 6001 at the heater 6002 is selected to be smaller than a cross-sectional area thereof at the inlet of the common liquid chamber 6005 (as disclosed in U.S. Pat. No. 4,752,787) are already known.

However, if the length of the nozzle is smaller than a certain value with respect to the heater position, when the temperature of the recording head is increased, a bubbling volume on the heater is increased, and the bubble formed by the bubbling may protrude from a rear end of the nozzle.

That is to say, as shown in FIG. 19A, even in case of a recording head a bubble 6007 is generated within a nozzle 6001 when the ink is bubbled in a condition that the recording head has a room temperature (for example, 25° C.), when ink is generated in a condition that the temperature in the recording head is increased (for example, to about 60° C. or more) due to discharging of ink from all nozzles with high frequency, since the energy required for the bubbling is small, if the energy similar to that shown in FIG. 19A is given, as shown in FIG. 19B, the bubble will be grown greatly to protrude toward the common liquid chamber 6005 from the nozzle 6001.

A state in which the ink is discharged in the condition that the temperature in the recording head is increased is shown in FIGS. 20A to FIG. 20E. FIG. 20A shows a condition that film boiling is started by heating the heaters 6002, 6003. From this condition, when the energy is further applied to the heaters 6002, 6003, the bobbles 6007 are grown as shown in FIG. 20B, with the result that the ink is discharged from the discharge port 6004 by pressure generated by the growth of the bubbles 6007. FIG. 20C shows a condition that the discharging of the ink is completed and the bubbles 6007 was grown to the maximum extent. In this condition, the bubble 6007 protrudes from the nozzle 6001 to reach the common liquid chamber 6005. From this condition, when the heating of the heaters 6002, 6003 is stopped to cool the bubbles 6007, contraction of the bubbles 6007 is started, and the re-fill of ink from the common liquid chamber is started and the ink near the discharge port is shifted, with the result that the meniscus starts to be retarded within the nozzle 6001. In the common liquid chamber communicated with the inlet of the nozzle, since the ink is flown into the nozzle at once around the bubble portion 6007 protruded in the common liquid chamber, eddy ink flow is created, with the result that, as shown in FIG. 20D, the bubble 6007 is separated. Thereafter, as shown in FIG. 20E, the bubbles 6007 on the heaters 6002, 6003 are disappeared, and the meniscus is restored in the vicinity of the discharge port 6004 as the ink re-fill continues. At this stage, the separated bubble 6007 remains within the common liquid chamber 6005.

Although the residual bubble 6010 remained within the common liquid chamber 6005 by single ink discharging in this way is small, when the ink is discharged from all of the nozzles with high frequency of about 10 kHz, a large amount of residual bubbles 6010 may be stored in the common liquid chamber for a short time. As shown in FIG. 21A, the stored or trapped residual bubbles 6010 is flown together with the ink during the ink re-fill to enter into the nozzle as shown in FIG. 21B, with the result that the complete ink re-fill may not be attained. Further, as shown in FIG. 21B, if the residual bubble 6010 covers the heater 6003, even when the heater 6003 is heated, a new bubble 6007 cannot almost be generated, with the result that the ink may not be discharged.

If the amount of residual bubbles in the common liquid chamber 6005 is small, although such residual bubbles can be removed by a suction recovery operation after the recording or during the recording, if the large amount of residual bubbles are generated for a short time, the suction recovery operation must be repeated frequently, with the result that an amount of useless ink sucked during the suction recovery operations is increased and the recording speed is worsened.

Further, if the nozzle 6001 is short, due to pressure energy transmitted from the rear end (connected to the common liquid chamber) of the nozzle 6001 to the common liquid chamber 6005 during the discharging of the ink droplet, a cross-talk phenomenon affecting a bad influence upon the ink discharging of the adjacent nozzle 6001 may occur.

Constructions of a nozzle 6001 suppressing or eliminating such bad influence such as poor discharging are shown in FIGS. 22A and 22B. In FIGS. 22A and 22B, for a purpose of comparison, the configuration of the nozzle 6001 of FIG. 17 is shown by the broken line.

In the construction shown in FIG. 22A, by lengthening the nozzle 6001, even when the bubbling is effected in the condition that the temperature in the recording head is increased, the bubble is prevented from protruding in the common liquid chamber 6005. However, with this construction, when the temperature in the recording head is high and viscosity of ink is low, although the short time re-fill can be achieved narrowly, if the temperature in the recording head is the room temperature, the re-fill time becomes very long and, thus, the recording with high frequency becomes impossible.

In the construction shown in FIG. 22B, by providing a restrict 6008 for restricting the flow cross-area at a rear end portion of the nozzle 6001 to increase flow resistance at the restrict (stricture), the bubble 6007 is prevented from growing toward the rearward of the nozzle 6001. However, in an arrangement in which the plurality of heaters 6002, 6003 are provided in the single nozzle 6001, there is the heater 6002 ahead of the rear heater 6003, and, by the bubbling action of the heater 6002, the bubble 6007 generated on the rear heater 6003 is pushed toward the rearward of the nozzle 6001. As a result, even when the flow resistance is increased at the rear portion of the nozzle 6001, the growing of the bubble 6007 toward the rearward of the nozzle 6001 cannot suppressed completely.

As mentioned above, in the ink jet recording head in which the plurality of heaters 6002, 6003 are provided in each nozzle 6001, sizes of areas on which the heaters are located become great in the longitudinal direction of the nozzle without fail. In this arrangement, if the length of the nozzle is increased, the re-fill time is increased; whereas, if the length of the nozzle is reduced, the residual bubbles are stored in the common liquid chamber 6005 and the stored residual bubbles flow back into the nozzle 6001 to generate the bad influence such as poor discharging. Thus, there is a "trade-off" relationship.

Further, if the ink supplying ability is enhanced by approaching the common liquid chamber to the discharge port, even when the single heater is used, the bubble may protrude in the common liquid chamber. The present invention also solve such a problem.

SUMMARY OF THE INVENTION

Therefore, an object of the present invention is to provide an ink jet recording head which can overcome the conventional trade-off problem and in which the re-fill time is shortened and the residual bubbles are not stored in a common liquid chamber and a high quality image can be recorded at a high speed.

The other objects and features of the present invention will be apparent from the following detailed explanation of the invention.

In order to solve the above problems, the present invention provides an ink jet recording head comprising a plurality of discharge ports for discharging ink droplets, a plurality of ink flow paths communicated with the respective discharge ports, a common liquid chamber communicated with the ink flow paths and adapted to hold ink to be introduced into the ink flow paths, electrothermal converting portions disposed in the ink flow paths and adapted to generate heat for bubbling the ink, and bubble trapping portions disposed at communicating portion between the ink flow paths and the common liquid chamber and including stepped structures each having a cross-sectional area smaller than a main cross-sectional area of the common liquid chamber and greater than a cross-sectional area of the corresponding ink flow path in a direction perpendicular to an ink introducing direction, and wherein each of the ink flow paths is provided with an inclined portion located between an upstream end of the electrothermal converting portion and the communicating portion of the ink flow path with the common liquid chamber in the ink introducing direction and having a cross-sectional area, in the direction perpendicular to an ink introducing direction, gradually increasing toward the upstream bubble trapping portion, and a surface extended from the inclined portion intersects with a ceiling surface of the bubble trapping portion.

By providing such an inclined portion, even if a bubble formed on the electrothermal converting portion is grown rearwardly, since a volume at an upstream side of the electrothermal converting portion is great, the grown bubble can be prevented from protruding in the common liquid chamber, thereby preventing the bubble from being separated during ink re-fill.

Further, even if the bubble protrudes in the common liquid chamber, since a main direction of the ink in the re-fill is inclined along the inclined surface to reduce a difference between this direction and a flow direction of ink going round from above the protruded bubble, eddy current is hard to occur, with the result that the ink is re-filled smoothly without separating the bubble.

Further, since the cross-sectional area of the inclined portion in the ink introducing direction is great and the flow resistance at the inclined portion is small and since the ink flows smoothly in the re-fill, the ink re-fill time can be shortened.

In addition, since the ink jet recording head according to the present invention has the bubble trapping portion, the bubble discharged from the upstream end of the ink flow path can be trapped in the bubble trapping portion, thereby preventing the bubble from flowing back in the ink flow path. In the ink jet recording head having such bubble trapping portions, by the above-mentioned bubble trapping action and the action of the inclined portion for preventing the bubble grown rearwardly of the ink flow path from being separated and stored in the common liquid chamber, the residual bubble can be prevented from being stored in the upstream side of the ink flow path and can be prevented from flowing back in the ink re-fill.

In this case, by adopting the arrangement in which the surface extended from the inclined portion intersects with the ceiling of the bubble trapping portion, since the ink flow in the re-fill has a main flow component advancing substantially straightly toward the ink flow path in an area surrounded by a surface extended from a side surface in the ink flow path in the ink introducing direction, the ink is not almost supplied from the common liquid chamber to a zone near the ink flow path from the intersect portion between the surface extended from the inclined portion and the ceiling of the bubble trapping portion, with the result that the flow of ink at this zone can be reduced, and the residual bubble can be trapped at this zone, thereby preventing the residual bubble from flowing back into the ink flow path.

By applying the present invention to an ink jet recording head in which the plurality of electrothermal converting elements are arranged side by side in the ink introducing direction, and, when the plurality of electrothermal converting elements are driven substantially simultaneously, by the growth of the bubble formed on the downstream electrothermal converting element, the bubble formed on the upstream electrothermal converting element is pushed toward the upstream side to facilitate the growth of the bubble toward the upstream side of the ink flow path (common liquid chamber side), the above-mentioned problem caused by the remarkably rearwardly grown bubble can effectively eliminated.

Further, by providing the restrict having the small cross-sectional area in the direction perpendicular to the ink introducing direction at an upstream side of the upstream end of the upstream-most electrothermal converting element and at a downstream side of the inclined portion, even when ink having low viscosity is used, the ink in the re-fill can be flown at a proper speed, and the ink can be prevented from being discharged from the discharge port during the re-fill. Particularly, by selecting a relationship between the cross-sectional area S1 of the restrict in the direction perpendicular to the ink introducing direction and the cross-sectional area S2 of the restrict at the upstream end thereof to $S1/S2 \leqq 0.5$, it is possible to bring the ink re-fill speed to an optimum value without generating eddy ink flow, thereby achieving this effect sufficiently.

In a case where it is assumed that an angle between the inclined portion and a surface on which the electrothermal converting element is located is $\alpha$ and an angle between the surface on which the electrothermal converting element is located and a surface connecting the upstream end of the upstream-most electrothermal converting element to an upper end of the rear end of the ink flow path is $\beta$, if $\alpha$ is too small with respect to $\beta$, in order to provide the arrangement in which the surface extended from the inclined portion intersects with the ceiling surface of the bubble trapping portion, it is required that the length of the bubble trapping portion be increased or the inclined portion be located at the downstream area form the upstream end of the electrothermal converting element. However, in the former case, the resistance in the suction recovery operation is increased not to effect the recovery sufficiently or lengthen the recovery time; whereas, in the latter case, the flow resistance rearwardly of the ink flow path becomes too small.

Further, if $\alpha$ is too great with respect to $\beta$, the volume of the area where the ink is hard to flow in the re-fill as mentioned above will be reduced.

Thus, it is desirable that a relationship between $\alpha$ and $\beta$ be selected to as follows:

$$\beta \leqq \alpha < \beta + 10^\circ.$$

DETAILED DESCRIPTION OF THE PREFERRED EMBODIMENTS

The present invention will now be explained in connection with embodiments thereof with reference to the accompanying drawings.

First, of all, in order to explain the effect of provision of an inclined portion 107, an ink jet recording head in which the inclined portion 107 is provided in an ink jet recording head having no bubble trapping portion 110 will be described as a reference example with reference to FIGS. 1A, 1B, 2A, 2B, 3 and 4.

Figures 1A, 1B:
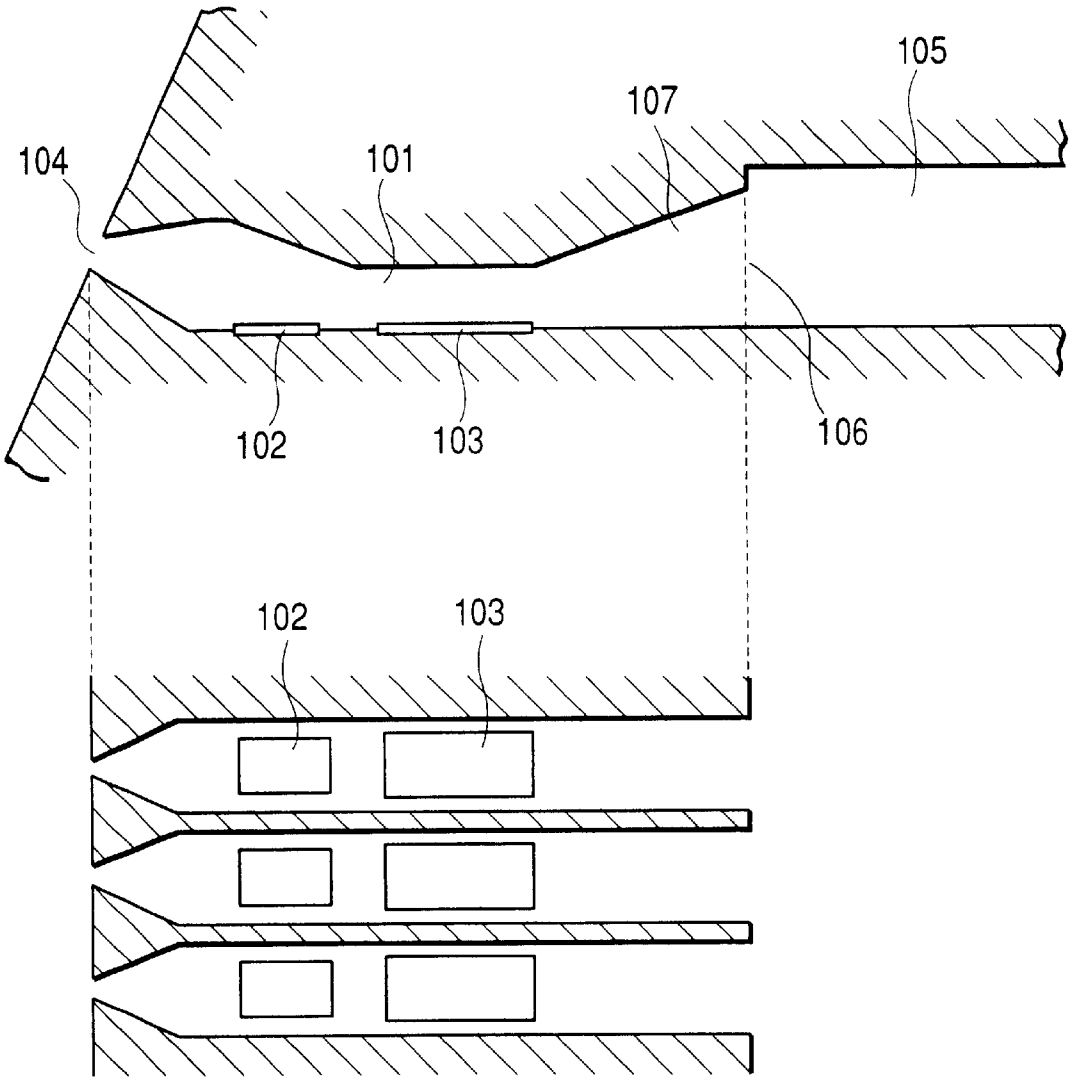
FIGS. 1A and 1B are schematic views showing an ink jet recording head according to a first reference example of the present invention.

FIGS. 1A and 1B are schematic views showing a construction of a nozzle portion 101 of the ink jet recording head as a first reference of the present invention, where FIG. 1A is a sectional view and FIG. 1B is a plan view.

As shown in FIGS. 1A and 1B, the ink jet recording head is of edge shoot type having a discharge port 104 for discharging liquid (ink) in a direction substantially perpendicular to a surface on which heaters (heat generating bodies) 102, 103 are formed. Within a nozzle (ink flow path) 101 communicating a common liquid chamber 105 for holding ink with and the discharge port 104 for discharging the ink, there are provided a small heater 102 disposed in the vicinity of the discharge port 104 and a large heater 103 disposed behind (toward the common liquid chamber 105) of the heater 102, which heaters are arranged side by side along a longitudinal direction of the nozzle 101. Between a rear end of the heater 103 and a rear end 106 of each nozzle 101, there is provided an inclined portion 107 in such a manner that a height of a ceiling (surface opposite to a surface on which the heaters 102, 103 are located) is gradually increased toward the rear end 106. A plurality of such nozzles 101 are arranged in parallel, and arrangement density thereof is 360 dpi. A height of the nozzle 101 at the position of the heater 103 is 30 $\mu$m and a height of the common liquid chamber 105 from an element substrate is 80 $\mu$m.

The heaters are connected to wirings (not shown) so that the heaters can be driven independently. An ink discharged amount when only the heater 102 is driven is set to about 13 pl, and an ink discharged amount when two heaters are driven is set to about 40 pl.

Figure 2A:
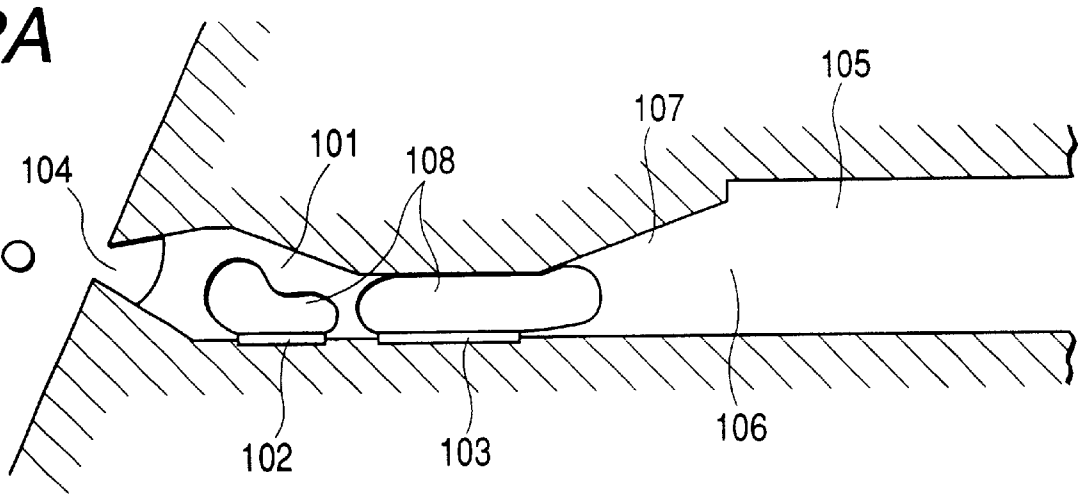
FIGS. 2A and 2B are views showing growth of a bubble in the ink jet recording head of FIGS. 1A and 1B when internal temperatures are different.
Figure 2B:
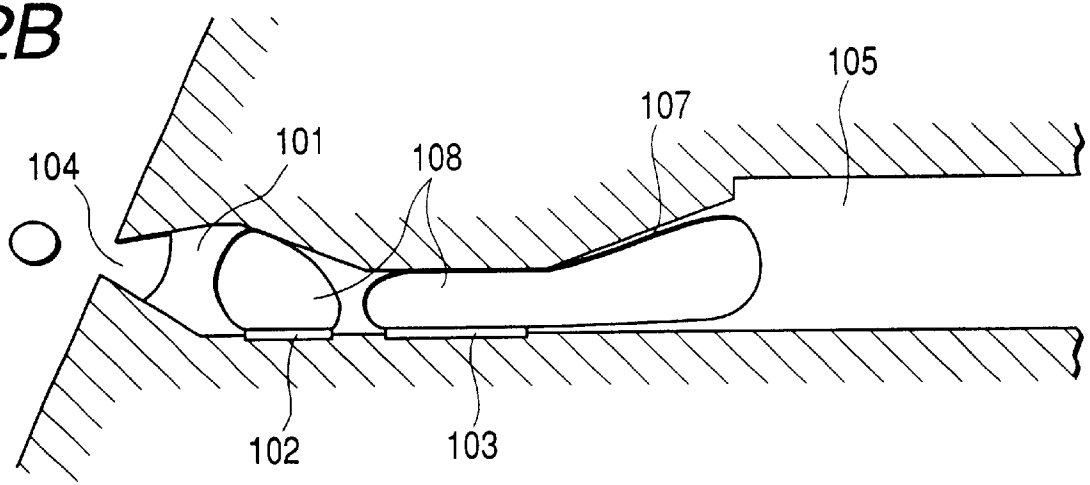

FIGS. 2A and 2B are views showing a state that the ink is discharged from the ink jet recording head, where FIG. 2A shows a case where the discharging is effected in a condition that a temperature in the head is a room temperature (about 25° C.) and FIG. 2B shows a case where the discharging is effected in a condition that the temperature in the head is increased (to about 60° C.). As shown in FIGS. 2A and 2B, in the ink jet recording head according to the illustrated embodiment, since the ceiling of the inclined portion 107 is gradually increased toward the rearward direction, the volume in this area is increased, with the result that, even in the condition that the temperature in the head is increased, a bubble 108 generated on the heater 103 can be prevented from protruding in the common liquid chamber 105. Thus, since the bubble 108 is not separated during extinction thereof, trapping of residual bubbles 108 in the common liquid chamber 105 can be suppressed. Further, even if the bubble is protruded in the common liquid chamber 105, since the ink flow in the re-fill has a main flow component along the inclined surface to deviate from a direction of flow of the ink flowing-in above the bubble 108, unlike to the above-mentioned conventional example, the eddy flow tending to separate the bubble 108 is hard to occur. In this way, in the ink jet recording head according to this reference example, since the residual bubbles 108 trapped in the common liquid chamber 105 can be reduced or eliminated, the residual bubbles 108 are prevented from flowing back into the nozzles 101, thereby suppressing a bad influence such as poor discharging.

Further, since the ceiling of the inclined portion 107 is smoothly changed toward the rearward direction, the ink flow in the re-fill is hard to be disturbed thereby to make the ink flow smooth, and, since the cross-sectional area of the flow path at the inclined portion 107 is great to reduce the flow resistance, the re-fill time can be shortened and the ink discharging with high frequency can be achieved.

Figure 3:
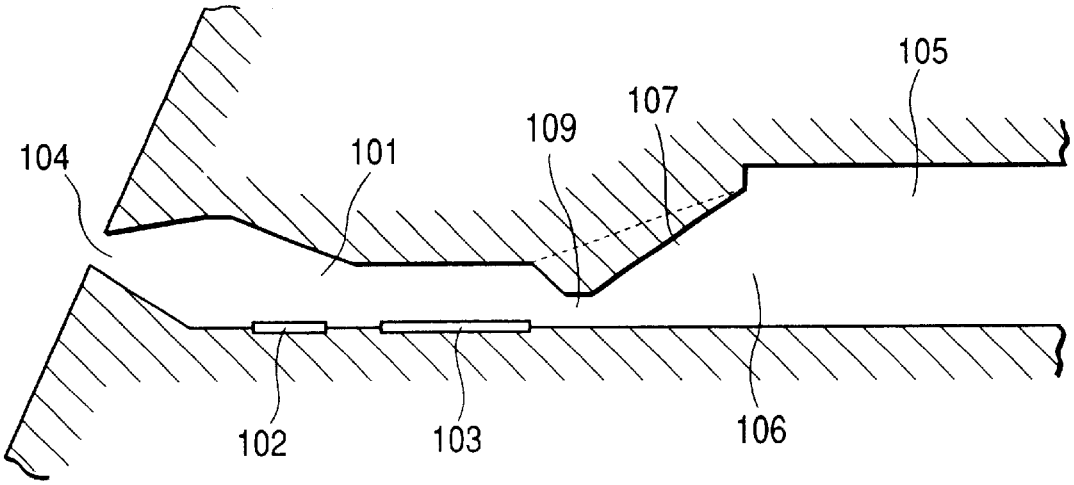
FIG. 3 is a schematic view showing an ink jet recording head according to a second reference example of the present invention.

FIG. 3 shows a construction of a nozzle portion 101 of an ink jet recording head according to a second reference example of the present invention. In FIG. 3, the same elements as those in the first reference example are designated by the same reference numerals and explanation thereof will be omitted. Further, as comparison, the configuration of the nozzle of the ink jet recording head according to the first reference example is shown by the broken line.

The ink jet recording head according to this reference example is characterized by a restrict portion 109 disposed behind of the heater 103 and having a low ceiling to reduce a cross-sectional area of the flow path. An inclined portion 107 behind the restrict portion 109 has a cross-sectional area smoothly increased toward the rearward direction, similar to the first reference example.

This reference example serves to suppress a drawback which would occur when the ink flow in the re-fill is too fast. Namely, in the first reference example, since the cross-sectional area of the inclined portion 107 is gradually or smoothly decreased, the ink is re-filled without disturbing the ink flow to shorten the re-fill time. However, depending upon surface tension and viscosity of the ink used, resistance of the ink flow path from an ink tank to the common liquid chamber 105, the volume of the common liquid chamber 105 and/or the number of nozzles, the ink flow in the re-fill may be too fast, with the result that, even when the meniscus is returned to the discharge port 104, the ink is overshot due to inertia of the ink, which may lead to overflow of ink at the discharge port. In this case, the meniscus may be vibrated greatly in the vicinity of the discharge port 104, with the result that the discharged amount may be greatly changed during the next ink discharging. That is to say, if the discharging is effected in the condition that the meniscus is protruded from the discharge port 104, the discharged amount will be increased; whereas, when the discharging is effected in the condition that the meniscus is retarded into the discharge port, the discharged amount will be decreased. Further, if the overshoot of the ink flow in the re-fill is great, the meniscus may be broken to wet the discharge port and therearound with the ink. If the ink is discharged in such a condition that there is a wet portion around the discharge port 104, a liquid droplet is pulled toward the wet portion, which results in a wrong discharging direction.

To avoid this, in this reference example, by providing the restrict portion 109 behind the heater 103, it is possible to obtain the ink flow in the re-fill at a moderate speed. By designing the restrict portion 109 in such a manner that a ratio (S1/S2) between a flow path cross-sectional area S1 of the restrict portion 109 and a flow path cross-sectional area S1 of the rear-most end of the nozzle 101 becomes 0.5 or less, the speed of the ink flow can be reduced effectively.

In this case, similar to the first reference example, since the inclined portion 107 behind the restrict portion 109 is configured so that the cross-sectional area thereof is gradually increased toward the rearward direction, even in the condition that the temperature in the recording head is high, the growth of the bubble 108 can be remained within the nozzle thereby to reduce the residual bubbles in the common liquid chamber 105, similar to the first reference example.

By appropriately selecting the configurations of the restrict portion 109 and the inclined portion 107, the ink jet recording head can be constructed so that the re-fill time becomes suitable for the driving frequency.

Figure 4:
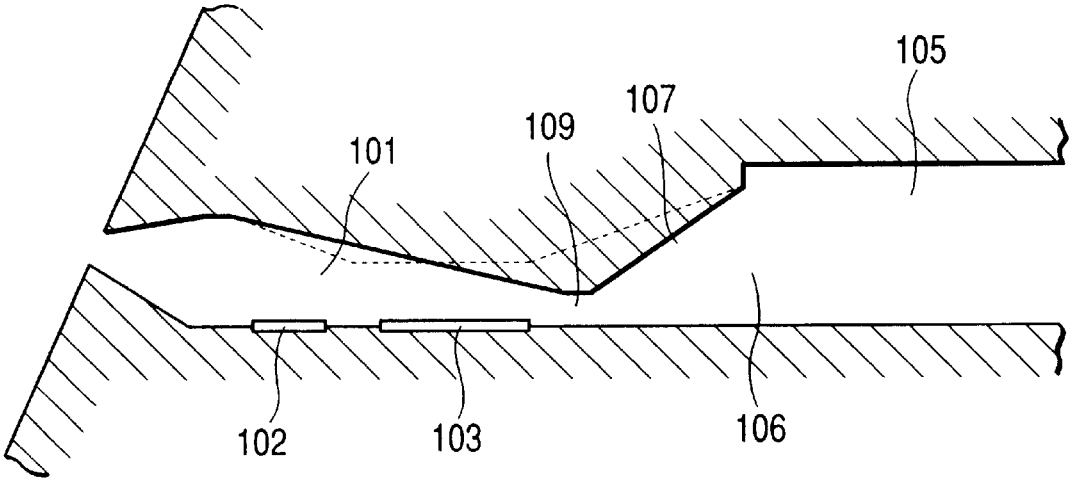
FIG. 4 is a schematic view showing an ink jet recording head according to a third reference example of the present invention.

FIG. 4 shows a construction of a nozzle of an ink jet recording head according to a third reference example of the present invention. In FIG. 4, the same elements as those in the first and second reference example are designated by the same reference numerals and explanation thereof will be omitted. Further, as comparison, the configuration of the nozzle of the ink jet recording head according to the first reference example is shown by the broken line.

In the ink jet recording head according to the second reference example, by providing the restrict portion 109, when the continuous recording is effected by driving only the heater 102, the small bubbles remained in the nozzle 101 are hard to be discharged toward the common liquid chamber 105, and, due to the presence of such bubbles remained in the nozzle, the discharging efficiency may be reduced and, thus, the discharged amount and discharging speed may be reduced. To avoid this, when the recording (small dot recording) is effected by driving only the heaters 102, in order to prevent the accumulation of the bubbles in the nozzle, at a certain period, ink discharge not contributing to the recording (preliminary discharge) is effected, i.e., ink discharge is effected with great discharging power by driving both heaters 102, 103, the bubbles remained in the nozzle 101 are discharged. However, as mentioned above, in the ink jet recording head according to the second reference example, since the bubbles are apt to be accumulated in the nozzle, the accumulated bubbles may not be discharged completely by only one preliminary discharge.

Thus, in the third reference example, the nozzle 101 is configured so that a height of the nozzle 101 is smoothly or gradually increased up to the heater portion 102 ahead of the heater 103. With this arrangement, since the flow resistance ahead of the heater 103 is decreased and forward pressure (when the heater 103 is driven) acts on the entire cross-section of the nozzle 101 effectively, the ability for discharging the bubbles accumulated in the nozzle 101 is enhanced, thereby solving the above-mentioned problem. Further, in the nozzle structures according to the first and second reference examples, when the preliminary discharge is effected, a part of the bubbles accumulated in the nozzle 101 may be discharged in the common liquid chamber 105. However, in the third reference example, since the effect for discharging the bubbles outside through the discharge port 104 is enhanced, when the preliminary discharge is effected, the bubbles are prevented from being discharged into the common liquid chamber 105, with the result that the bubbles are hard to be accumulated in the common liquid chamber 105 and the number of suction recovery operations for removing the bubbles can be reduced.

Next, an embodiment of the present invention in which an inclined portion 107 is provided in an ink jet recording head having a bubble trap 110 will be explained with reference to FIGS. 5 to 11. This embodiment is characterized in that a bubble trap 110 is provided in each of the ink jet recording heads according to the first to third reference examples and a surface extended from an inclined surface 107 intersects with a ceiling surface of the bubble trap 110. Now, such characteristic will be fully explained.

Figure 5:
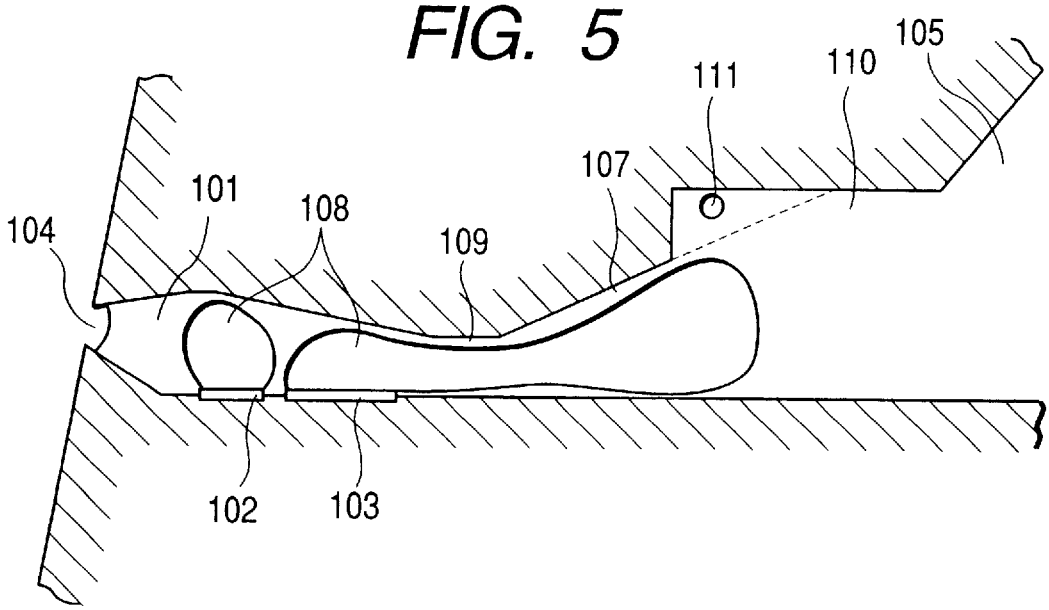
FIG. 5 is a schematic view showing an ink jet recording head according to an embodiment of the present invention.

FIG. 5 is a sectional view of a nozzle portion 101 of an ink jet recording head according to the embodiment of the present invention. In FIG. 5, the same element as those in the first to third reference examples are designated by the same reference numerals and explanation thereof will be omitted.

In this embodiment, as shown in FIG. 5, an inclined portion 107 is provided in an ink jet recording head which includes a structure disposed between a nozzle 101 and a common liquid chamber 105 and having a height greater than a height of the nozzle 101 and smaller than a height of the common liquid chamber 105 and having a stepped portion with respect to the nozzle 101 and in which a bubble trap 110 communicating with a plurality of nozzles 101 is provided. The bubble trap 110 serves to trap residual bubbles 111 remained in the recording head therein to avoid a bad influence upon the ink discharging. That is to say, a part of bubbles 108 generated in the nozzle 101 may be remained in the nozzle as the residual bubbles 111 even after extinction of the bubbles 108 due to cooling of the bubbles by deposition of liquid solved in the ink. When the ink is discharged, such residual bubbles 111 are shifted by the ink flow (in the nozzle 101) directing toward the common liquid chamber 105. When the residual bubbles reach the bubble trap 110, since the cross-sectional area of the flow path is abruptly increased at this area, the speed of the ink flow is abruptly reduced, with the residual bubbles are not further shifted and are trapped in the bubble trap.

Figure 6:
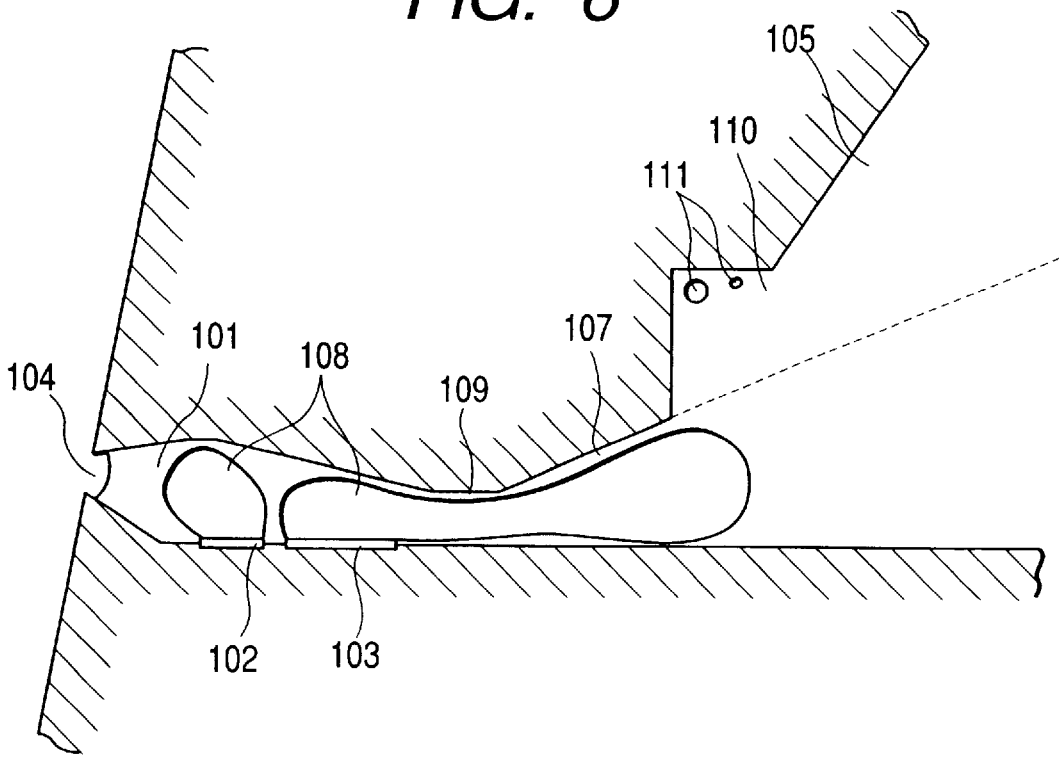
FIG. 6 is a schematic view for explaining a characteristic of the ink jet recording head of FIG. 5, showing an ink jet recording head in which a surface extended from an inclined portion does not intersect with a bubble trapping portion.

When the inclined portion 107 is provided in the ink jet recording head having such a bubble trap 110, as shown in FIG. 6, if an extension line (surface) from a ceiling of the inclined portion 107 does not intersect with a ceiling of the bubble trap 110, during the re-fill of the ink into the nozzle 101, a part of the ink supplied from the common liquid chamber 105 enters into the bubble trap 110 and then flows downwardly along the bubble trap. The residual bubbles 111 trapped in the bubble trap 110 is shifted by this ink flow and then may be flown back into the nozzle 101. To avoid this, as shown in FIG. 5, it is desirable that the extension line from the ceiling of the inclined portion 107 intersects with the ceiling of the bubble trap 110. With this arrangement, when the ink is re-filled into the nozzle 101, an area where ink flow is almost not caused is created at a corner portion (left and upper portion in FIG. 5) constituting the stepped portion of the bubble trap 110, thereby preventing the residual bubbles 111 from flowing back into the nozzle 101.

If the section of the ceiling portion of the inclined portion 107 is not straight but is curved, by designing so that a tangential line (tangential plane) of the ceiling of the inclined portion 107 at the boundary between the nozzle 101 and the bubble trap 110 intersects with the ceiling of the bubble trap 110, the same effect can be achieved.

Figure 7:
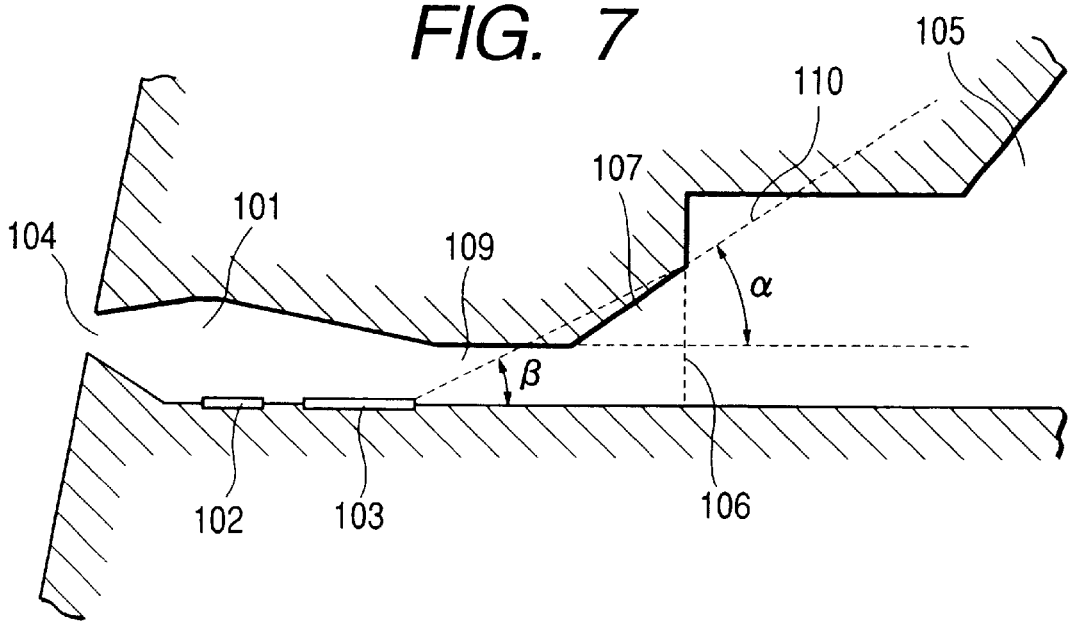
FIG. 7 is a schematic view for explaining a relationship between angles $\alpha$ and $\beta$, showing an ink jet recording head when $\alpha$ is slightly greater than $\beta$.

Now, the configuration of the inclined portion 107 will be described in more detail. Hereinbelow, as shown in FIG. 7, it is assumed that the section of the ceiling portion of the inclined portion 107 is straight and an angle between this straight line and a bottom surface on which the heaters 102, 103 are located is a and an angle between the bottom surface and a straight line connecting a rear end of the rear-most heater 103 in the nozzle 101 to the boundary between the ceiling of the nozzle 101 and the bubble trap 110 is $\beta$. Incidentally, if the section of the ceiling portion of the inclined portion 107 is not straight but is curved, when it is assumed that an angle between a tangential line (tangential plane) of the ceiling of the nozzle 101 at the boundary between the nozzle 101 and the bubble trap portion 110 is $\alpha$, the following explanation is established, similar to the case where the section of the ceiling portion is straight.

Figure 8:
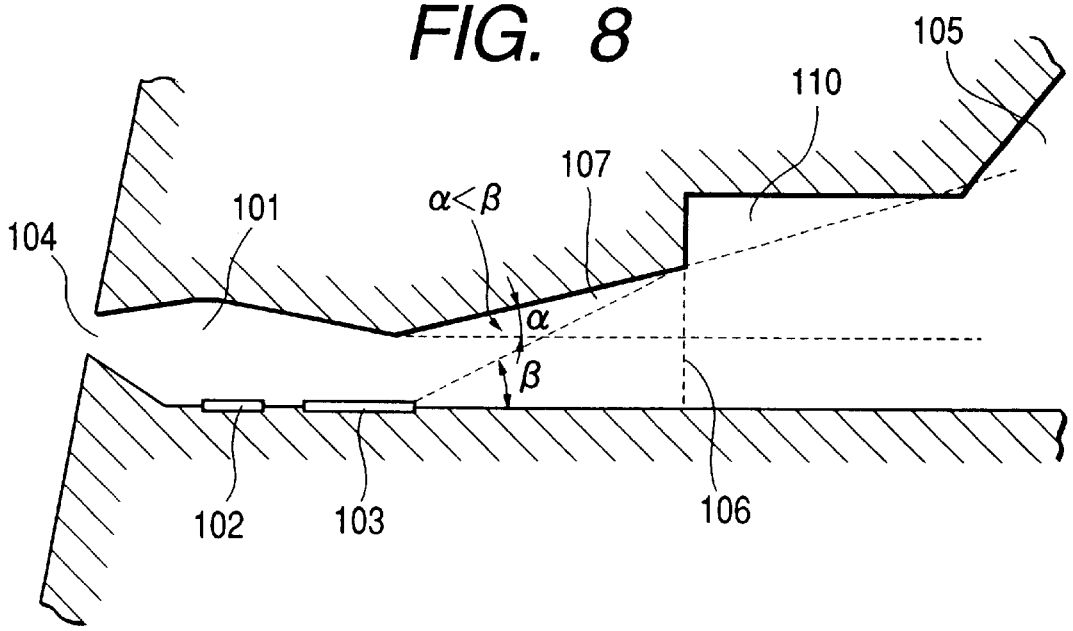
FIG. 8 is a schematic view for explaining a relationship between angles $\alpha$ and $\beta$, showing an ink jet recording head when $\alpha$ is slightly smaller than $\beta$.
Figure 9:
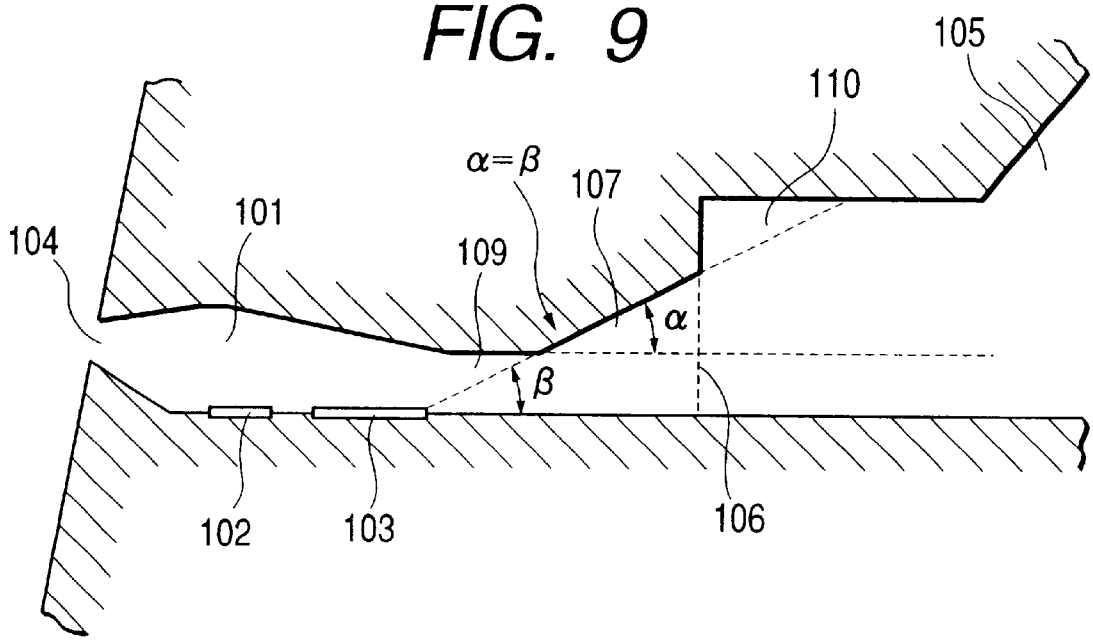
FIG. 9 is a schematic view for explaining a relationship between angle $\alpha$ and $\beta$, showing an ink jet recording head when $\alpha$ is equal to $\beta$.
Figure 10:
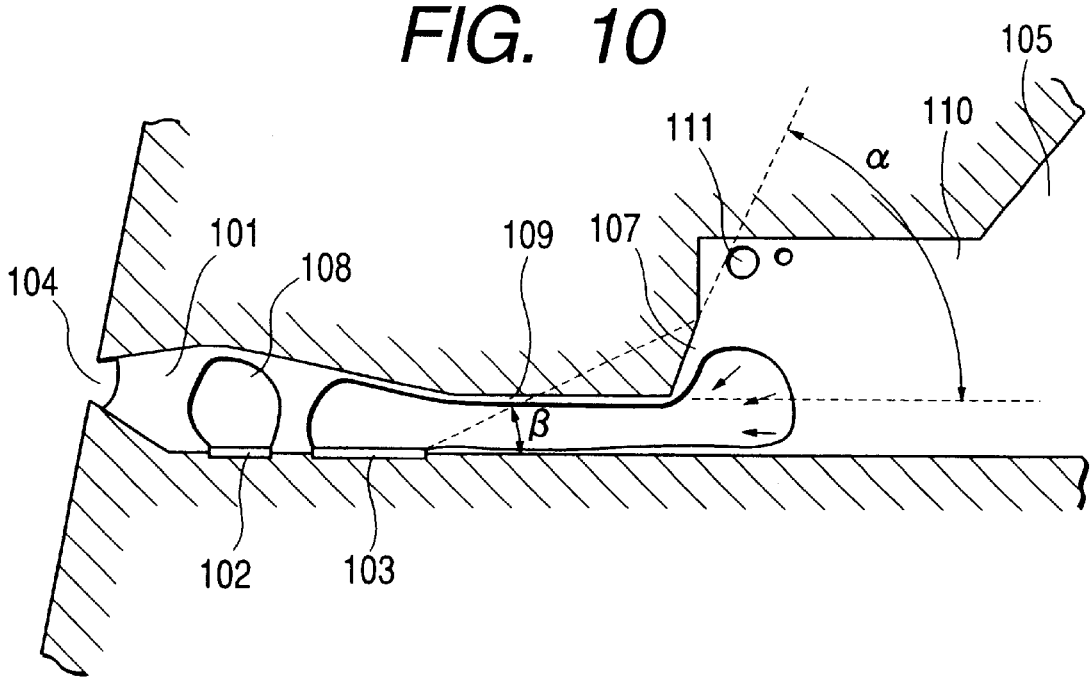
FIG. 10 is a schematic view for explaining a relationship between angles $\alpha$ and $\beta$, showing an ink jet recording head when $\alpha$ is greater than $\beta$.

When a is smaller than $\beta$, as mentioned above, in order to design so that the extension line from the inclined portion 107 intersects with the ceiling of the bubble trap 110, it is required that the bubble trap 110 be lengthened. In such a case, the flow resistance during the suction recovery is increased, with the result that it is difficult to remove the bubbles in the common liquid chamber and/or the bubble trap portion completely or the recovery time is lengthened, thereby reducing the recording speed. As shown in FIG. 8, if a starting point of the inclined portion 107 is positioned ahead of the rear end of the heater 103, the flow resistance behind the heater 103 is reduced considerably, with the result that the bubble 108 formed on the heater 103 is greatly shifted rearwardly. Thus, it is desirable that the value of the angle a be at least greater than the value of the angle $\beta$. As shown in FIG. 9, if $\alpha$ and $\beta$ have the same value, since the direction of the ink flow in the vicinity of the ceiling of the inclined portion 107 in the re-fill and the direction of the inclination of the ceiling of the inclined portion 107 becomes substantially the same, the ceiling of the inclined portion 107 does almost not give the resistance to the ink flow, thereby achieving the smooth re-fill. When the ink flow in the re-fill is too fast for example due to low viscosity of the ink, as shown in FIG. 7, by selecting the angle $\alpha$ to be slightly greater than the angle $\beta$, the ceiling of the inclined portion 107 gives the resistance to the ink flow in the re-fill, with the result that the flow speed can be reduced to the moderate speed. However, as shown in FIG. 10, if the angle $\alpha$ is set to be too great, the area in the bubble trap 110 (left and upper portion above the broken line in FIG. 10) where the ink flow in the re-fill is hard to occur becomes smaller, with the result that the residual bubbles 111 cannot be remained. From the above, it is desirable to set the value of the angle $\alpha$ as follows:

$$\beta \leqq \alpha < \beta + 10^\circ.$$

Figures 11A, 11B, 11C:
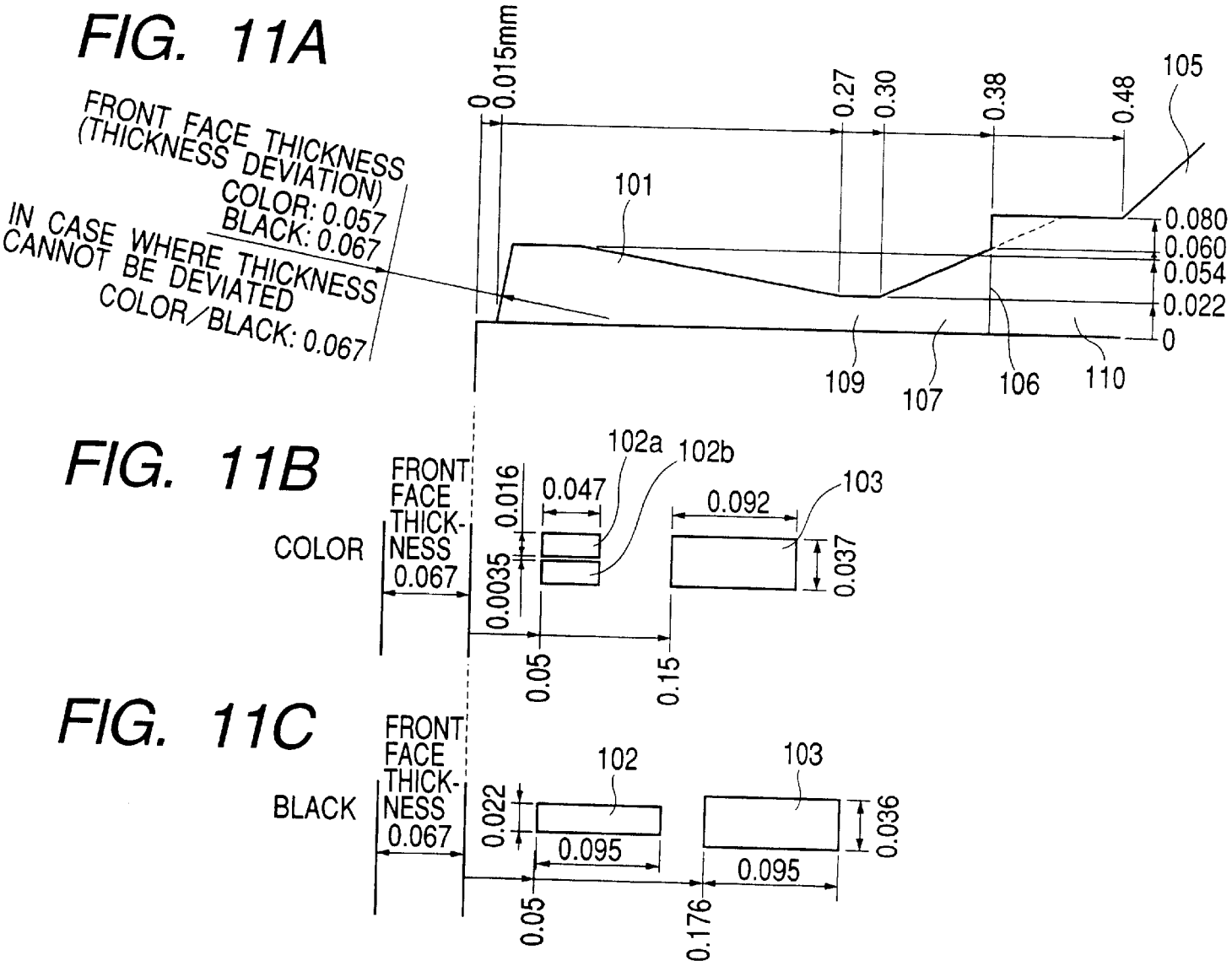
FIGS. 11A, 11B and 11C are views showing an dimensional example of the ink jet recording head of FIG. 5.

FIGS. 11A to 11C show a dimensional example of the ink jet recording head according to the illustrated embodiment, where FIG. 11A is a sectional view showing the configuration of the nozzle 101, FIG. 11B is a plan view showing the arrangement of the heaters 102, 103 in the nozzle 101 when color ink is discharged and FIG. 11C is a plan view showing the arrangement of the heaters 102, 103 in the nozzle 101 when black ink is discharged.

Incidentally, in the above-mentioned reference examples and embodiment, while the ink jet recording head having two heaters was explained, the present invention can be applied to an ink jet recording head having three or more heaters or an ink jet recording head having a single heater. In any cases, the arrangement shown in the above-mentioned reference examples and embodiment may be applied to a nozzle construction from a rear end of a rear-most heater in the nozzle to a rear-most end of the nozzle.

<Ink Jet Recording Head Cartridge>

Figure 12:
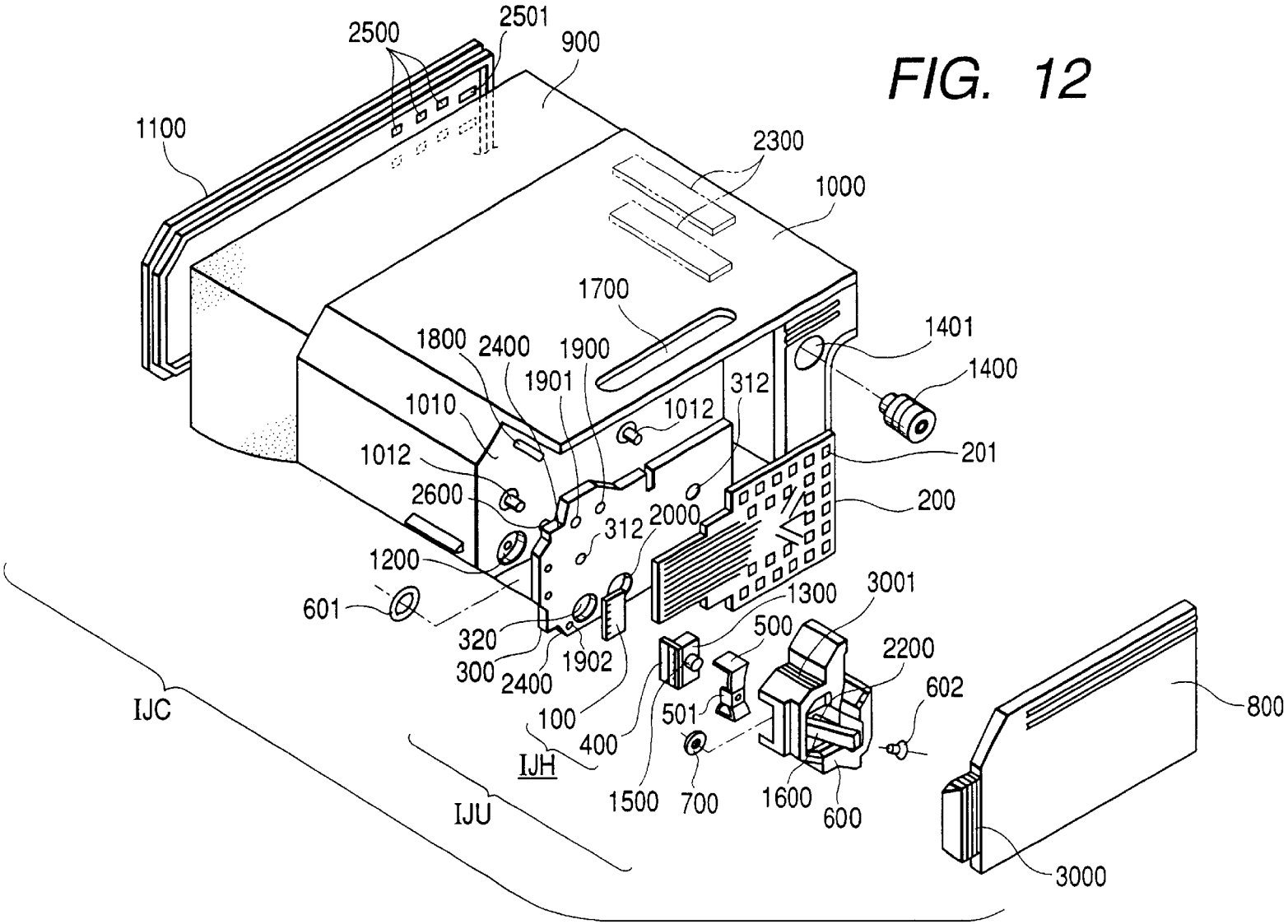
FIG. 12 is an exploded perspective view showing an example of an ink jet recording head cartridge on which an ink jet recording head according to the present invention is mounted.

FIG. 12 is an exploded perspective view showing an example of an ink jet recording head cartridge using an ink jet recording head constructed as mentioned above.

In FIG. 12, an ink jet recording head unit IJU is of type in which ink is discharged by causing film boiling in the ink by generating thermal energy in response to an electrical signal. A heater board 100 is constituted by forming a plurality of electrothermal converting elements (heaters) arranged as an array and adapted to generate thermal energy and electrical wirings made of aluminum and adapted to supply electric power to the heaters on an Si-substrate by a film forming technique. A wiring substrate 200 has wirings corresponding to the wiring on the heater board 100 (respective wirings are interconnected by wire bonding, for example), and pads 201 disposed at ends of the wirings and each adapted to receive the electrical signal from a main body of the apparatus. A top plate 1300 has partition walls for defining nozzles corresponding to a plurality of discharge ports and a common liquid chamber and integrally incorporates an ink introduction port 1500 for receiving the ink supplied from an ink tank and directing the ink to the common liquid chamber, and an orifice plate 1400 in which the plurality of discharge ports are formed. The partition walls of the top plate 1300 are integrally formed with the top plate 1300. To this end, the top plate is preferably formed from polysulfone. However, other molding resin material may be used.

The wiring substrate 200 is supported on a support 300. The support 300 is formed from metal, for example and constitutes a constructural member of the recording head unit. An urging spring 500 has an M-shaped configuration and serves to urge a portion of the top plate 1300 corresponding to the common liquid chamber by the center of "M" and to urge a portion of the top plate 1300 corresponding to the nozzles by line contact of a front protruded portion 501. When foot portions of the urging spring 500 inserted into holes 312 of the support 300 to be engaged with the back surface of the support, the heater board 100 and the top plate 1300 are pinched between the support 300 and the urging spring 500, with the result that the heater board 100 and the top plate 1300 can be urged against and secured to the support 300 by biasing forces of the urging spring 500 and the front protruded portion 501 thereof. The support 300 has two positioning 312, 1900 for receiving two positioning projections 1012 provided on the ink tank and two projections 1800 for effecting positioning and fusion holding and is also provided at its back surface with a positioning projection 2600 for positioning the head cartridge with respect to a carriage of the main body of the apparatus. In addition, the support 300 has also a hole 320 through which an ink supply tube 2200 (described later) permitting ink supply from the ink tank can be inserted. The attachment of the wiring substrate 200 to the support 300 is effected by using an adhesive and the like.

Figure 13:
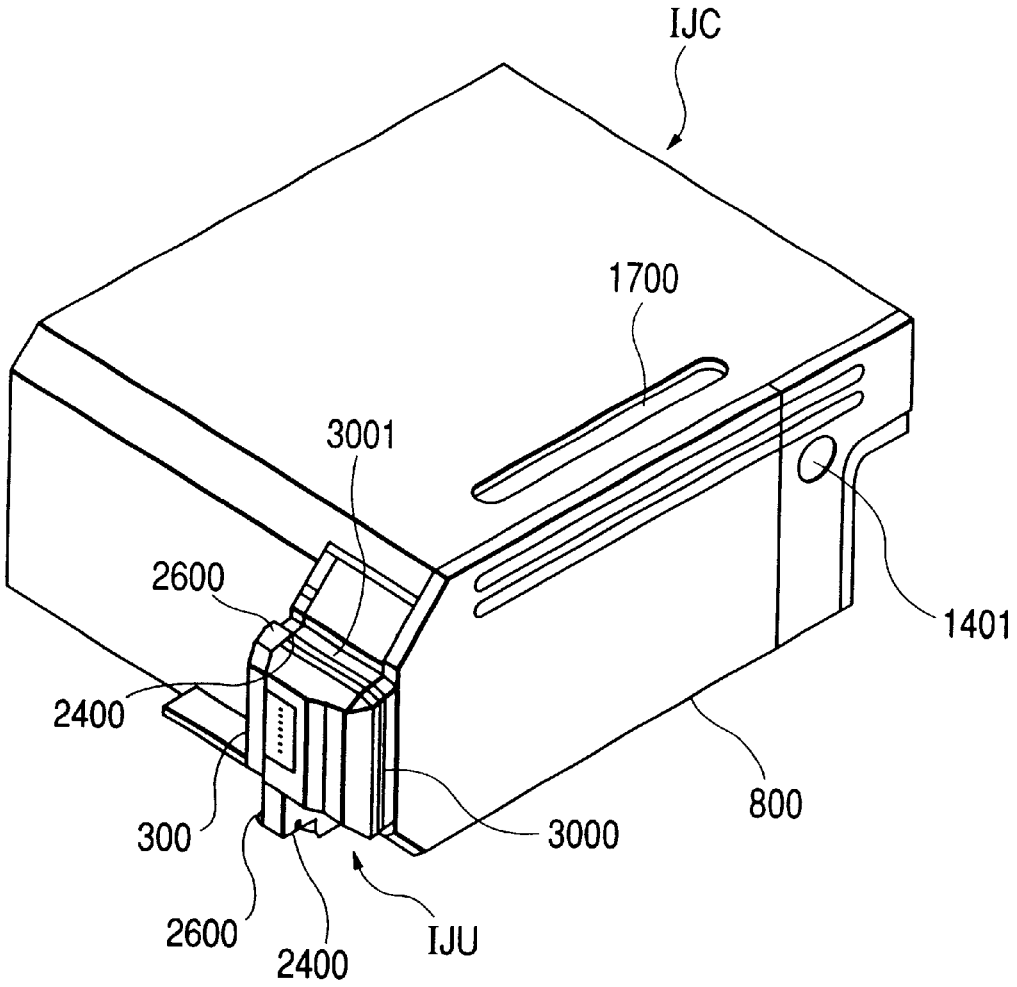
FIG. 13 is a perspective view of the ink jet recording head cartridge of FIG. 12 after assembled.

Incidentally, two recesses 2400 of the support 300 are located in the vicinity of the positioning projections 2600, respectively. These recesses are positioned on extension of a plurality of parallel grooves 3000, 3001 formed in three sides of the ink jet recording head unit IJU in the head cartridge assembled as shown in FIG. 13 thereby to prevent waste matters such as dirt and ink from reaching the projections 2600. A lid member 800 in which the parallel grooves 3000 are formed serves to cover a portion for containing the ink jet recording head unit IJU and forms a part of an outer wall of the head cartridge IJC. Further, an ink supply path member 600 in which the parallel grooves 3001 are formed serves to support an ink conduit 1600 connected to the ink supply tube 2200 to be communicated with the ink supply path in a cantilever fashion in which a connecting end of the conduit to the supply tube 2200 is fixed. Further, the member 600 has a seal pin 602 for maintaining a capillary phenomenon between the ink supply tube 2200 and the fixed portion of the ink conduit 1600. Incidentally, a supply port portion 1200 provided on the ink tank is provided with a packing 601 and a filter 700 for effecting connection and seal between the ink tank and the supply tube 2200. The ink supply path member 600 is formed cheaply with high positional accuracy by molding. Further, since the conduit 1600 is formed in the cantilever fashion, in the mass production, the conduit 1600 can stably be urged against the ink introduction port 1500. In this example, in this urged condition, sealing adhesive is supplied from the ink supply path member side.

Incidentally, the securing of the ink supply path member 600 to the support 300 is simply effected by inserting pins (not shown) provided on the back surface of the ink supply path member 600 into holes 1901, 1902 of the support 300 and by heat-fusing pin portions protruded from the back surface of the support 300. Incidentally, since slight protruded areas on the back surface formed by the heat-fusion are housed in recesses (not shown) formed in a side wall of the attachment surface of the ink tank to the ink jet recording head unit IJU, the positioning of the ink jet recording head unit IJU is not obstructed.

The ink tank comprises a cartridge body 1000, an ink absorbing body 900, and a lid 1100 for sealing the ink absorbing body 900 after the ink absorbing body is inserted from a side surface opposite to the ink jet recording head unit attachment surface of the cartridge body 1000. The ink tank is provided with the supply port 1200 for supplying the ink to the ink jet recording head unit IJU. As will be described later, this supply port is used as a pouring port for impregnating the absorbing body 900 with ink by poring the ink from the supply port 1200 in a step before the ink jet recording head unit IJU is positioned in a head arranging portion 1010 of the cartridge body 1000.

Ribs 2300 formed on an inner surface of the body 1000 and ribs 2500, 2501 provided on an inner surface of the lid 1100 define, within the ink tank, an air existing area contiguous to an atmosphere communicating port 1401, thereby well maintaining ink supplying ability from the ink absorbing body. Four (only two of which are shown in FIG. 9) ribs 2300 are formed in parallel with a carriage shifting direction at a rear part of the cartridge body 1000, thereby preventing the absorbing body from closely contacting with the body 1000. Further, the ribs 2501, 2500 are disposed on extension lines from the ribs 2300 and formed on the inner surface of the lid 1100. However, unlike to the ribs 2300, the ribs 2500, 2501 have split shapes. Thus, the ribs 2500, 2501 provide wider air existing areas than the ribs 2300. Incidentally, the ribs 2500, 2501 are dispersed and formed on a lower part of the right half of the lid 1100. Due to the presence of these ribs, the ink in the corner area of the ink absorbing body 900 remotest from the supply port 1200 of the tank is more stabilized and is positively directed to the supply port 1200 by the capillary force. In order to effect good and uniform ink pouring to the absorbing body to prevent the ink from entering into the air existing area, it is desirable that the ink be poured through the ink supply port 1200 located in the vicinity of the corner area remotest from the air existing area.

An ink containing space of the ink tank has a rectangular shape in a horizontal plane, and, since the ribs 2500, 2501 are located at ends of the longitudinal side of the rectangle, the air existing area can effectively be formed in the area where the ink is hard to be directed to the supply port 1200. Thus, this arrangement of the ribs 2500, 2501 is particularly effective. When the ink containing portion is elongated along the carriage shifting direction or has a cubic configuration, since the entire portion contacted with the lid 1100 constitutes the area where the ink paced apart from the supply port 1200 is hard to be directed, by providing ribs on the entire lid 1100, the air existing area is formed on the lid portion 1100, thereby stabilizing the ink supplying from the ink absorbing body 900.

Within the atmospheric communication port 1401 for communicating the interior of the ink tank with the atmosphere, a liquid repelling member 1400 is provided thereby to prevent the ink from leaking from the atmospheric communication port 1401.

The ink jet recording head unit IJU is covered, except for a lower opening, by the ink tank and the lid 800 for covering the ink jet recording head unit IJU after the ink jet recording head unit IJH is mounted to the ink tank. Further, in a condition that the ink jet recording head cartridge IJU is mounted to the carriage of the main body of the ink jet recording apparatus IJRA, since the lower opening is located closely adjacent to the carriage HC, the ink jet recording head unit IJU is substantially closed at its four sides. As a result, heat from the ink jet recording head IJH is uniformed radiated in a space around the ink jet recording head IJH four sides of which is closed, and the temperature in the space is kept uniform. However, for example, when the ink jet recording head IJH is continuously driven for a long term, the temperature in the space may be slightly increased. In consideration of this, in this example, by providing a slit 1700 having a width smaller than the space in an upper surface of the cartridge, natural radiation is promoted to prevent the temperature increase and to make distribution of temperature of the entire ink jet recording head unit IJU uniform without depending upon the environment.

As shown in FIG. 13, in the condition assembled as the ink jet recording head cartridge IJC, the ink is directed from the supply port 1200 of the ink tank to the conduit 1600 of the ink supply path member 600 through a hole 320 formed in the support 300 and a supply tube 2200 passing through an introduction opening formed in the center of a rear surface of the ink supply path member 600 and passes through the conduit and is supplied to the common liquid chamber of the ink jet recording head IJH through the ink introduction port 1500 of the top plate 1300. A packing made of silicone rubber or a butyl rubber is provided at a connecting portion between the supply tube 2200 and the conduit 1600 to seal the connecting portion, thereby ensuring the sealing ability of the ink supply path.

Incidentally, in the illustrated embodiment, the top plate 1300 is formed from resin having excellent anti-ink corrosion such as polysulfone, polyether sulfone, polyphenylene oxide or polypropylene and is simultaneously molded with the orifice plate 400 by resin molding using a mold.

<Ink Jet Recording Apparatus>

Figure 14:
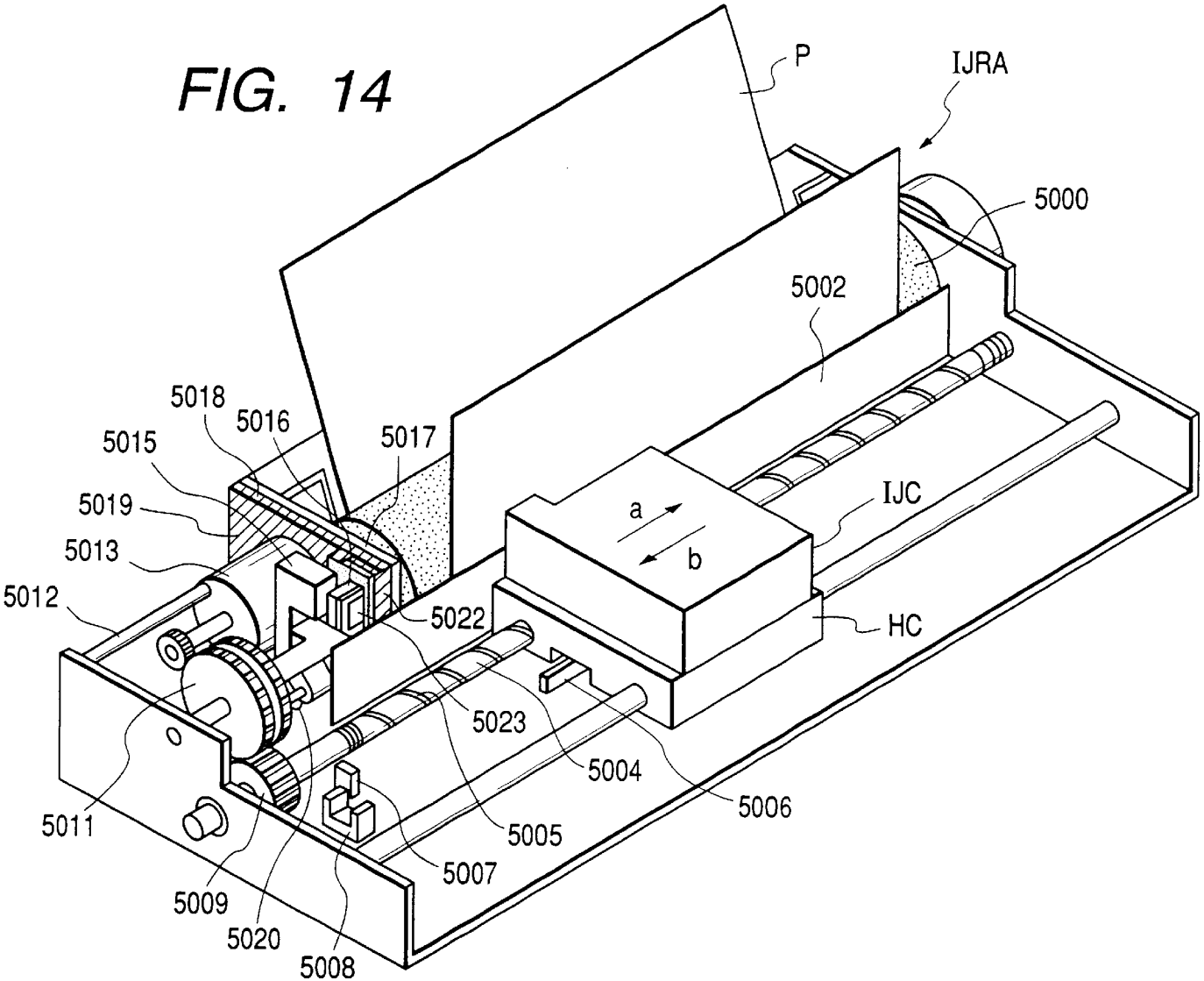
FIG. 14 is a schematic view showing an example of an ink jet recording apparatus on which the ink jet recording head cartridge of FIG. 12 is mounted.

FIG. 14 is a perspective view of the ink jet recording apparatus IJRA using the ink jet recording head cartridge according to the present invention. The ink jet recording head cartridge IJC integrally including the ink jet recording head IJH and the ink tank storing the ink to be supplied to the recording head is mounted on the carriage HC. A pin (not shown) of the carriage HC is engaged by a helical groove 5005 of a lead screw 5004 rotatingly driven by rotation of a drive motor 5013 through drive transmitting gears 5011, 5009, so that the carriage is reciprocally shifted in axial directions (shown by the arrows a, b in FIG. 14) in synchronous with the rotation of the lead screw 5004.

A paper P as a recording medium is urged against a platen (not shown) by a paper urging plate 5002 so that a position of the paper P on which the recording is effected by the shifting movement of the carriage HC is correctly maintained.

A photo-coupler 5007, 5008 as home position detecting means is disposed at an end of the shifting direction of the carriage HC. When the carriage HC is shifted to the home position at the end of the shifting direction and a lever 5006 of the carriage HC approaches the photo-coupler 5007, 5008, the lever is detected by the photo-coupler, and processing such as switching of rotational direction of the motor 5013 and the like is effected on the basis of a detection signal.

In an opposed relationship to the ink jet recording head IJH, there are provided a cap member 5022 supported by a cap member supporting member 5016 and adapted to cap a front surface of the ink jet recording head IJH, and suction means 5015 for sucking the interior of the cap. The cap member and the suction means effect suction recovery of the ink jet recording head IJH through an opening 5023 of the cap. Further, a cleaning blade 5017 is disposed aside the cap member and can be shifted in a front-and-rear direction by a cleaning blade shifting member 5019. The blade and the shifting member are supported by a body support plate 5018. As the cleaning blade 5017, any well-known cleaning blade can be used, an well as the illustrated one. Capping, cleaning and suction recovery operations are started when the lover 5012 is shifted by a shifting movement of a cam 5020 engaged by the carriage. For such shifting movements, a driving force from the drive motor is used through well-known transmitting means such as a switching clutch. That is to say, the capping, cleaning and suction recovery means are designed so that desired processes are effected at respective positions by the action of the lead screw 5005 when the carriage HC is positioned at the home position. Such operations may be effected at well-known timings to achieve the desired processes.

In the illustrated embodiment, while the ink jet recording apparatus using the ink jet recording head cartridge IJC integrally including the ink jet recording head IJH and the ink tank was explained, the present invention may be applied to an ink jet recording apparatus in which an ink tank and an ink jet recording head IJH are provided independently and ink is supplied from the ink tank to the ink jet recording head IJH through a very fine tube.

Figure 15:
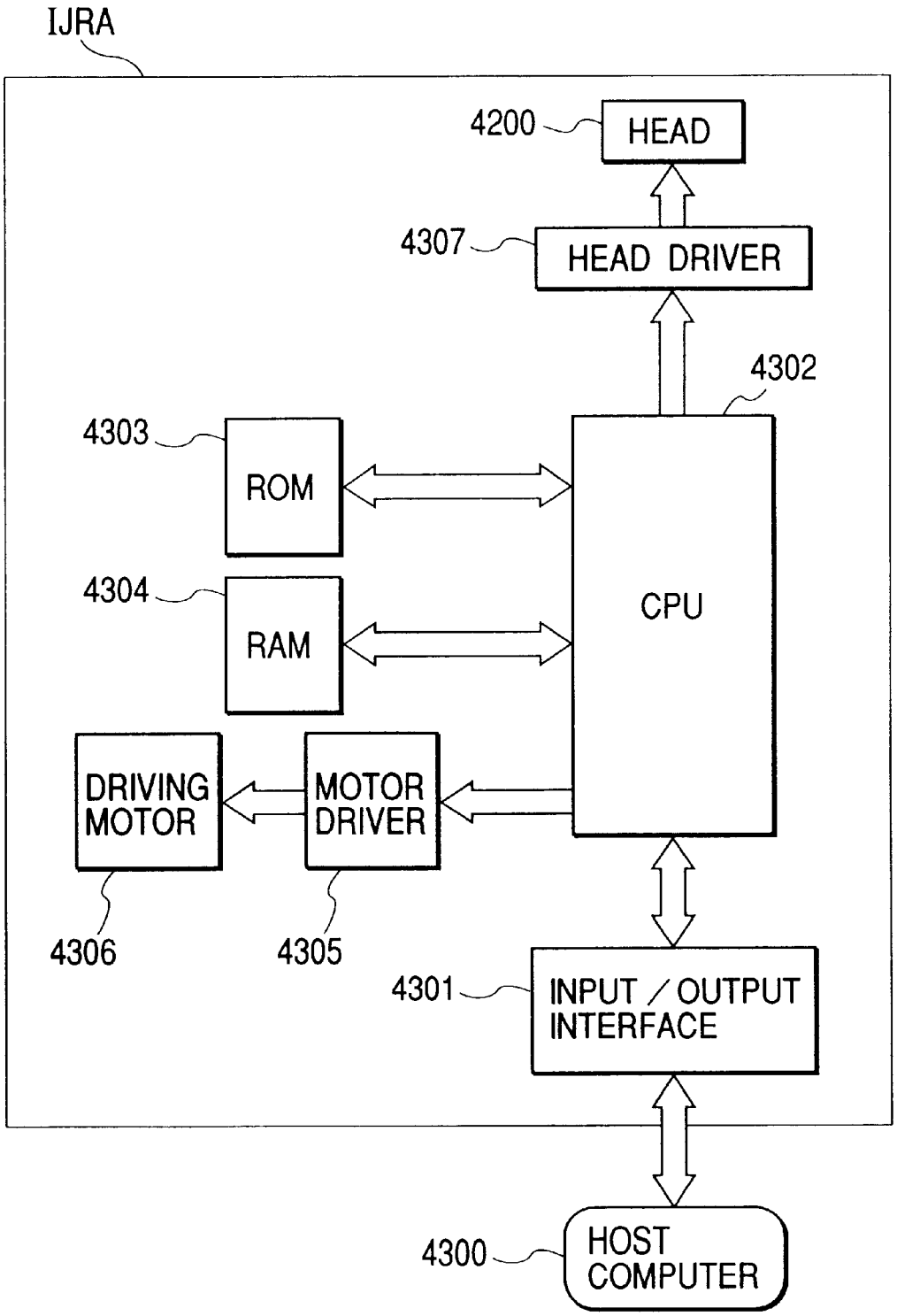
FIG. 15 is a block diagram for recording of the ink jet recording apparatus of FIG. 14.

FIG. 15 is a block diagram showing a recording operation of the ink jet recording apparatus shown in FIG. 14.

The recording apparatus receives a signal corresponding to recording information from a host computer 4300. This signal is temporarily stored in an input interface 4301 in the recording apparatus and at the same time is converted into data processable in the recording apparatus and then is inputted to a CPU 4302 for effecting supplying of a head drive signal and the like. The CPU 4302 serves to process the data inputted to the CPU 4302 on the basis of control program stored in a ROM 4303 by using peripheral units and to convert the data into data to be recorded (image data). Further, the CPU 4302 serves to form drive data for driving a drive motor 4306 for shifting the recording medium and the recording head in response to the image data. The image data and the motor drive data are transmitted to the head 4200 and the drive motor 4306 through a head driver 4307 and a motor driver 4305, respectively, so that the head and the motor are driven by the timings corresponding the data, thereby forming the image.

As the recording medium which can be applied to the above-mentioned recording apparatus and on which liquid such as ink is applied, various papers, an OHP sheet, plastic material used for compact discs and decoration plates, cloth, metallic material such as aluminum or copper, leather material such as cow leather, pig leather or synthetic leather, wood material such as wood or plywood, bamboo, ceramic material such as talc, or a three-dimensional network structure such as sponge can be used.

The ink jet recording apparatus according to the illustrated embodiment may include a printer for effecting the recording on various papers or the OHP sheet, a plastic recording apparatus for effecting the recording on the plastic material such as a compact disc, a metal recording apparatus for effecting the recording on the metallic plate, a leather recording apparatus for effecting the recording on the leather, a wood recording apparatus for effecting the recording on the wood, a ceramic recording apparatus for effecting the recording on the ceramic material, a recording apparatus for effecting the recording on the three-dimensional network structure such as sponge, and a print device for effecting the recording on the cloth.

Further, as the discharging liquid (ink) used in the ink jet recording apparatus, liquid compatible with the recording medium and the recording condition may be used.

Next, another embodiment of an ink jet recording apparatus for effecting recording on the recording medium using the ink jet recording head according to the present invention will be explained.

Figure 16:
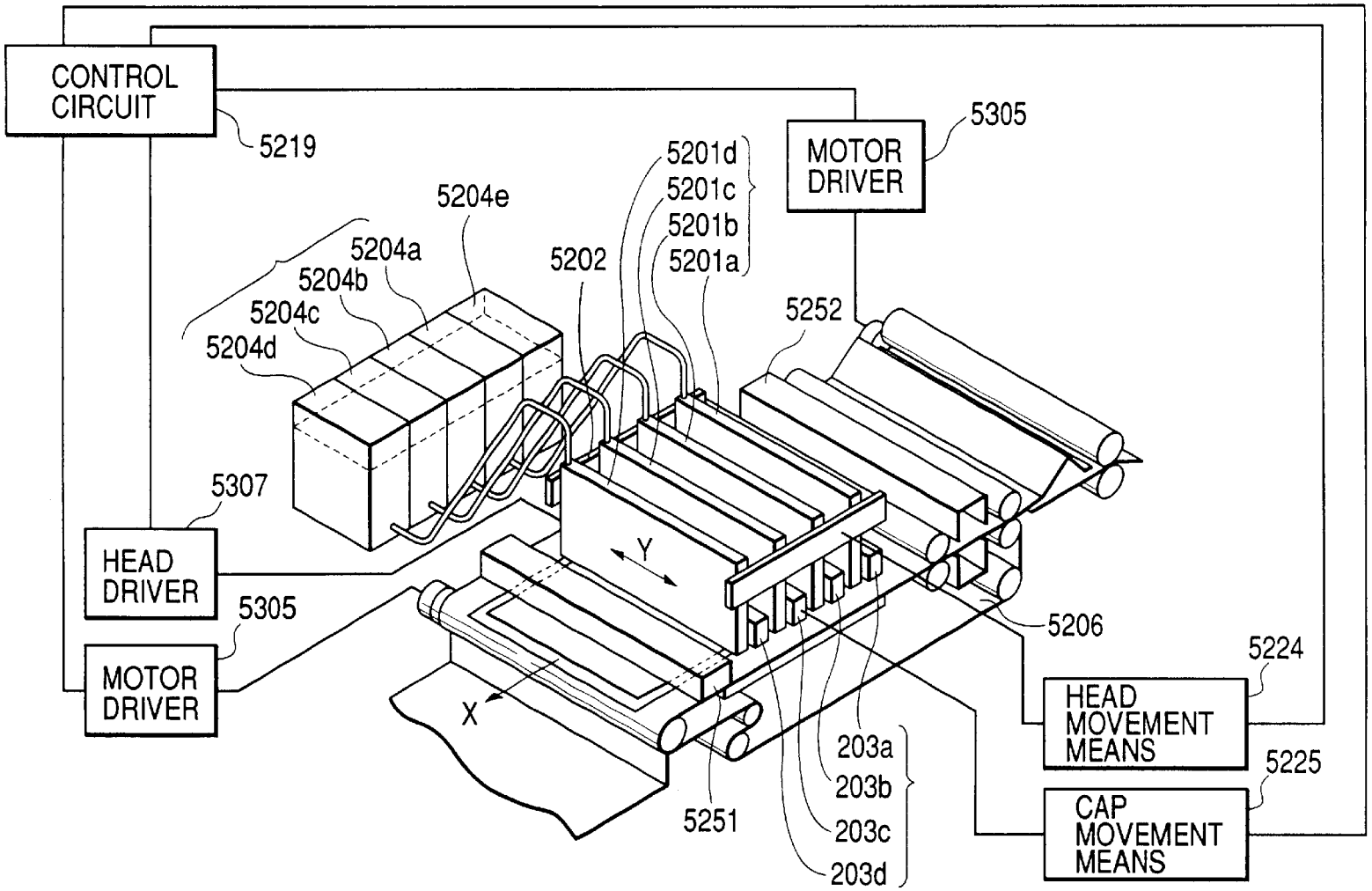
FIG. 16 is a schematic view showing another example of an ink jet recording apparatus on which an ink jet recording head according to the present invention is mounted.
Figure 17:
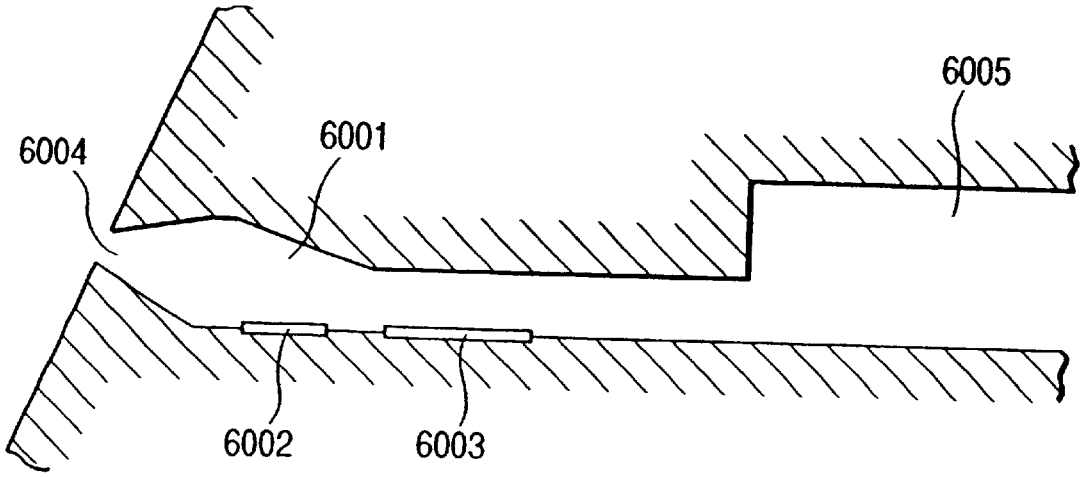
PRIOR ART FIG. 17
FIG. 17 is a schematic view showing a conventional ink jet recording head.
Figure 18:
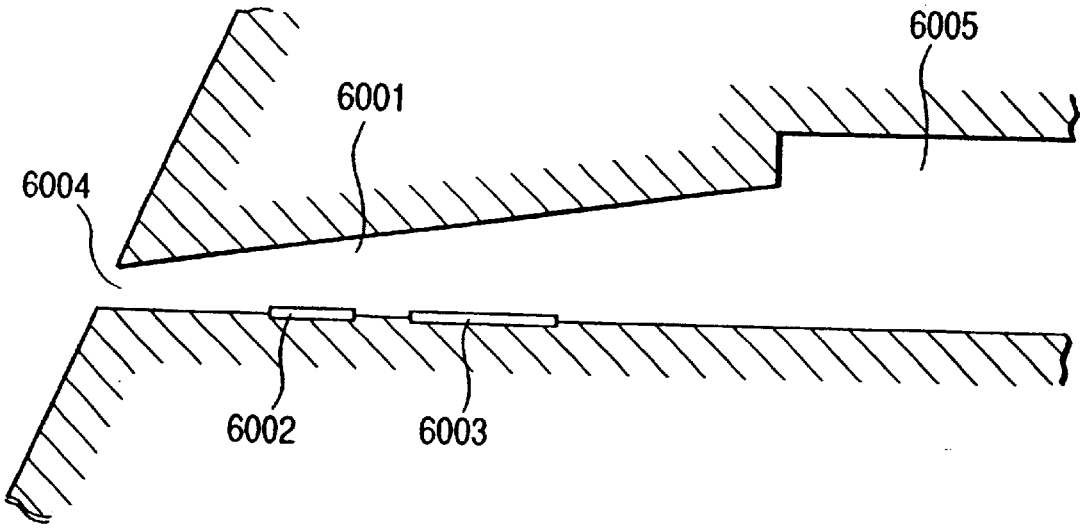
PRIOR ART FIG. 18
FIG. 18 is a schematic view showing another conventional ink jet recording head.
Figure 19A:
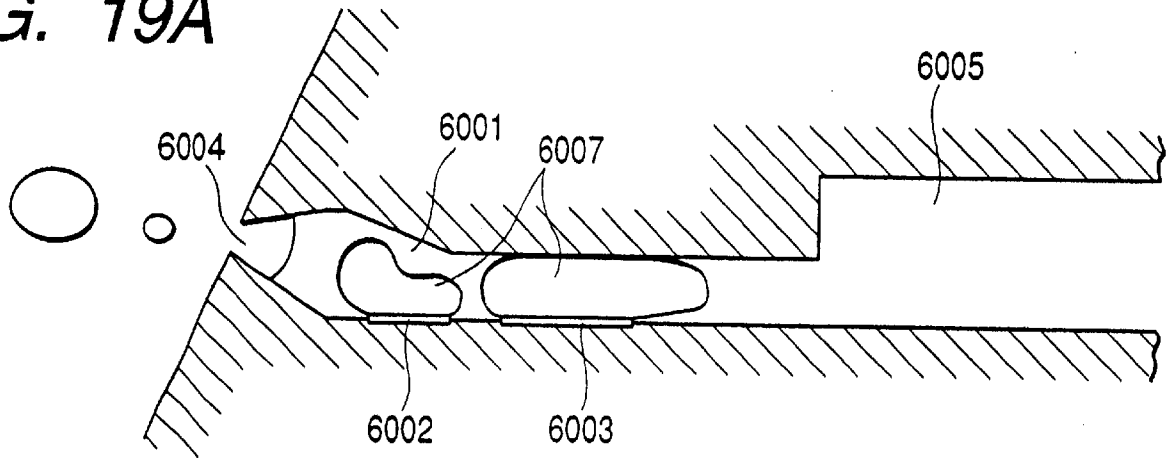
PRIOR ART FIG. 19A
FIGS. 19A and 19B are views showing growth of a bubble in the ink jet recording head of FIG. 17 when internal temperatures are different.
Figure 19B:
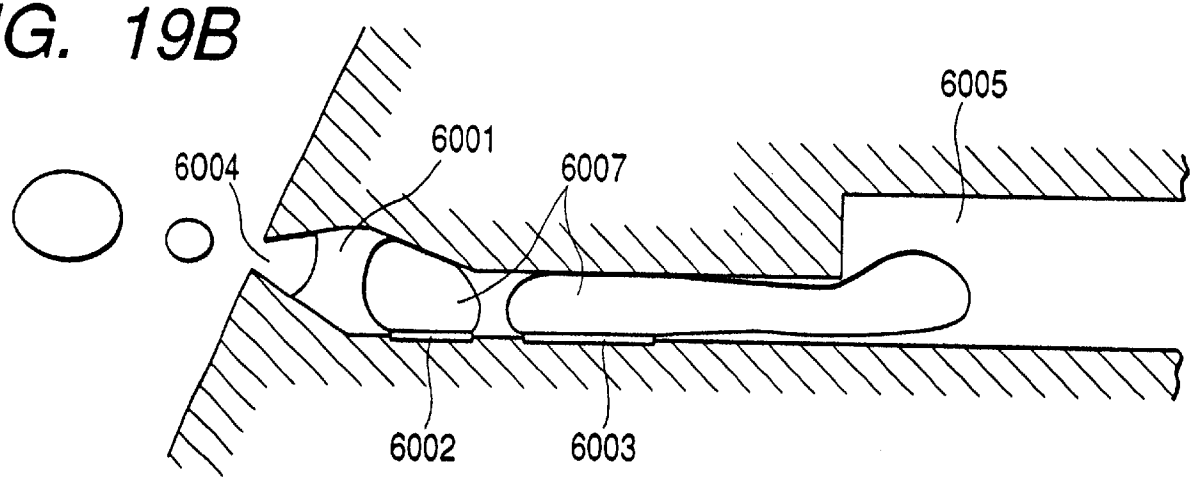
PRIOR ART FIG. 19B
Figure 20A:
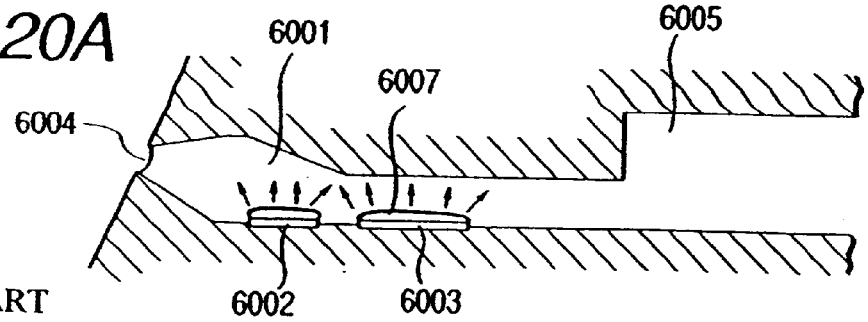
PRIOR ART FIG. 20A
FIGS. 20A, 20B, 20C, 20D and 20E are schematic views showing a state that ink is discharged in the ink jet recording head of FIG. 17.
Figure 20B:
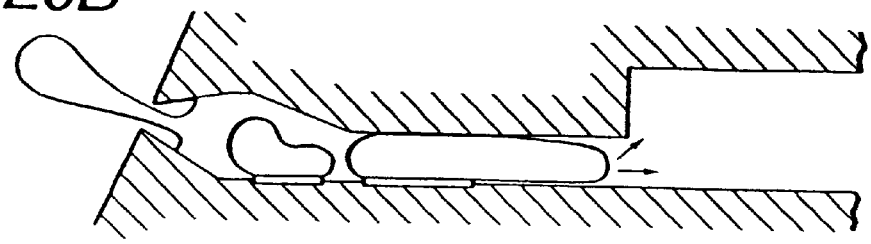
PRIOR ART FIG. 20B
Figure 20C:
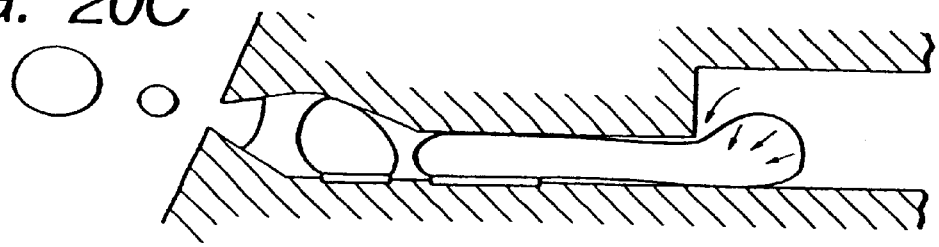
PRIOR ART FIG. 20C
Figure 20D:
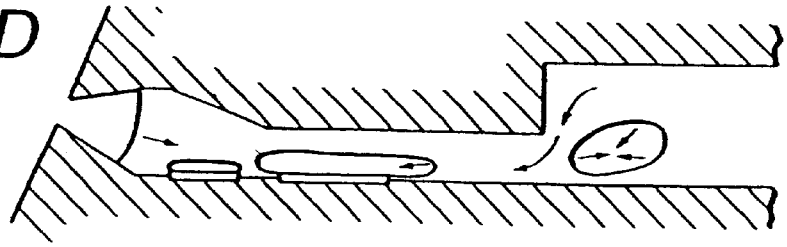
PRIOR ART FIG. 20D
Figure 20E:
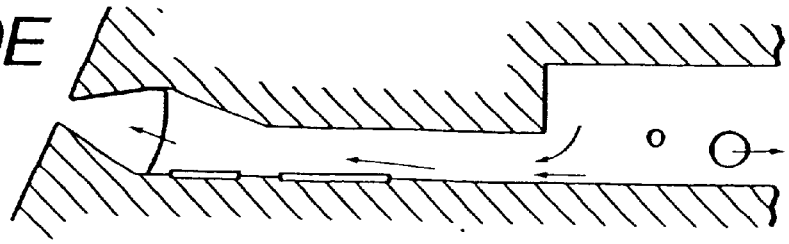
PRIOR ART FIG. 20E
Figure 21A:
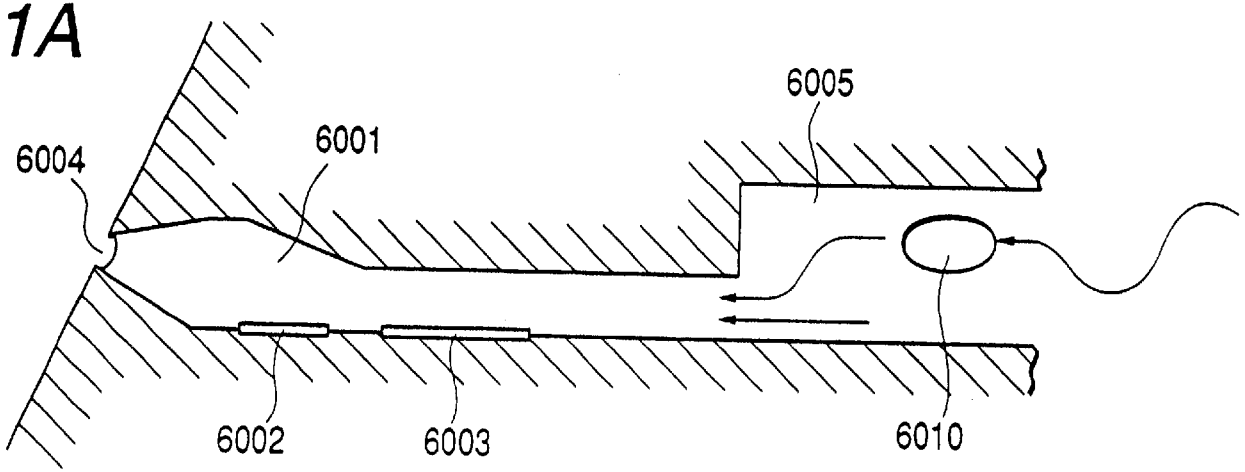
PRIOR ART FIG. 21A
FIGS. 21A and 21B are schematic views showing a state that a residual bubble is flown back into a nozzle in re-fill in the ink jet recording head of FIG. 17.
Figure 21B:
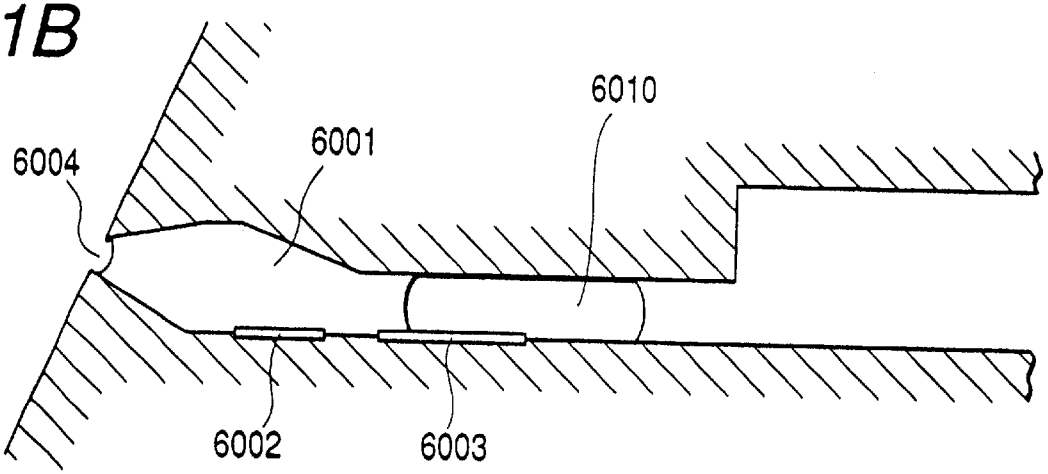
PRIOR ART FIG. 21B
Figure 22A:
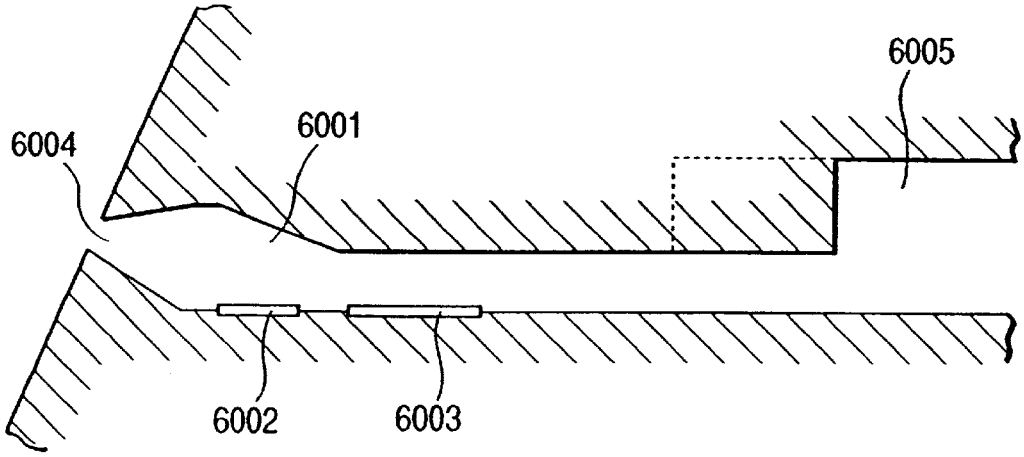
PRIOR ART FIG. 22A
FIGS. 22A and 22B are schematic views showing a further conventional ink jet recording head.
Figure 22B:
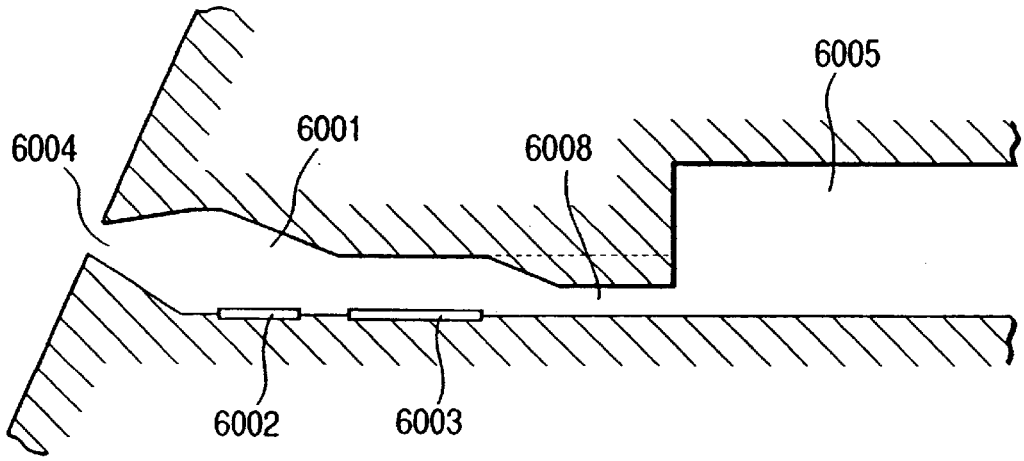
PRIOR ART FIG. 22B

FIG. 16 is a schematic view showing a construction of the ink jet recording apparatus using the above-mentioned ink jet recording head 5201 according to the present invention. The ink jet recording head 5201 according to the illustrated embodiment is of full-line type in which a plurality of discharge ports are arranged in an area having a length corresponding to a recording width of a recording medium 5227 at interval of 360 dpi. In this embodiment, four heads corresponding to four colors (i.e., yellow (Y), magenta (M), cyan (C) and black (Bk)) are fixedly supported by a holder 5202 in parallel with each other along a conveying direction (X direction in FIG. 16) of the recording medium with a predetermined interval.

A signal is supplied from a head driver 5307 as drive signal supply means corresponding to the ink jet recording heads 5201*a* to 5201*d*, and, on the basis of this signal, the corresponding ink jet recording head 5201 is driven.

Four color (Y, M, C and Bk) inks are supplied to the ink jet recording heads 5201*a* to 5201*d* as discharging liquids from respective ink tanks 5204*a* to 5204*d*. A bubbling liquid container 5204*e* for storing bubbling liquid is disposed in alignment with the ink tanks 5204*a* to 5204*d*, and the bubbling liquid is supplied to the recording heads from the bubbling liquid container 5204*e*.

Further, below the ink jet recording heads 5201*a* to 5201*d*, there are disposed head caps 5203*a* to 5203*d* each including an ink absorbing member such as sponge, which head caps serve to maintenance of the heads by covering the heads when the recording operation is not performed.

The recording medium 5227 is located on a conveying belt 5206 mounted on a plurality of rollers along a predetermined path and is conveyed by driving a drive roller 5214 connected to a motor driver 5305. The conveying belt 5206 and the drive roller 5214 constitute conveying means for the recording medium 5227.

In the ink jet recording apparatus according to the illustrated embodiment, a pre-processing device 5251 and a post-processing device 5252 for effecting various processes with respect to the recording medium 5227 before and after the recording are arranged at an upstream side and a downstream side of a recording area in a conveying path of the recording medium 5227.

The pre-process and the post-process have different contents in accordance with the kind of the recording medium 5227 to be recorded and the kind of the ink used.

As the pre-process, for example, regarding the recording medium such as metal, plastic or ceramic, ultraviolet ray and ozone are illuminated on the recording medium to make the surface thereof active, thereby enhancing the ink adhering ability. Further, regarding the recording medium on which electrostatic electricity is apt to be generated, due to the presence of the electrostatic electricity, dirt may easily be adhered to the surface of the recording medium, and good recording may be obstructed by such dirt. Thus, as the pre-process, by removing the electrostatic electricity on the recording medium by using an ionizer device, the dirt is removed from the recording medium. Further, when the cloth is used as the recording medium, in order to prevent the sweating and to enhance the adhering ability, a process for applying substance selected among alkaline substance, water-soluble substance, synthetic polymer, water-soluble metal salt, urea and thiourea to the cloth as the pre-process. The pre-process is not limited to the above-mentioned ones but may be a process for adjust the temperature of the recording medium to a temperature suitable for the recording.

On the other hand, the post-process may include a fixing process for promoting the fixing of the ink applied to the recording medium 5227 and a process for cleaning residual processing agent applied in the pre-process and remained in a non-reaction state.

Incidentally, in the illustrated embodiment, while the ink jet recording apparatus using the full-line head as the ink jet recording head was explained, the present invention is not limited to such an apparatus but may be applied to a recording apparatus in which the recording is effected by shifting the above-mentioned compact head in a direction of the conveying direction of the recording medium 5227.

What is claimed is:

1. An ink jet recording head comprising:

a plurality of discharge ports for discharging ink droplets;

a plurality of ink flow paths communicated with the respective discharge ports;

a common liquid chamber communicated with said ink flow paths and adapted to hold ink to be introduced into said ink flow paths;

electrothermal converting portions disposed in said ink flow paths and adapted to generate heat for bubbling the ink; and bubble trapping portions disposed at communicating portion between said ink flow paths and said common liquid chamber and including stepped structures each having a cross-sectional area smaller than a main cross-sectional area of said common liquid chamber and greater than a cross-sectional area of the corresponding ink flow path in a direction perpendicular to an ink introducing direction; and wherein each of said ink flow paths is provided with an inclined portion located between an upstream end of said electrothermal converting portion and the communicating portion of said ink flow path with said common liquid chamber in the ink introducing direction and having a cross-sectional area, in the direction perpendicular to the ink introducing direction, gradually increasing toward the upstream bubble trapping portion, and a surface extended from said inclined portion intersects with a ceiling surface of said bubble trapping portion.

2. An ink jet recording head according to claim 1, wherein said electrothermal converting portion comprises a plurality of electrothermal converting elements arranged side by side in the ink introducing direction.

3. An ink jet recording head according to claim 1, wherein said inclined portion has a restrict portion disposed at an upstream side of the upstream end of said electrothermal converting portion and at a downstream side of said inclined portion and having a narrower cross-sectional area in the direction perpendicular to the ink introducing direction.

4. An ink jet recording head according to claim 3, wherein a relationship between a cross-sectional area S1 of said ink flow path in the direction perpendicular to the ink introducing direction and a cross-sectional area S2 of the upstream end of said ink flow path in the direction perpendicular to the ink introducing direction satisfies $S1/S2 \leqq 0.5$.

5. An ink jet recording head comprising:

a plurality of discharge ports for discharging ink droplets;

a plurality of ink flow paths communicating with the respective discharge ports;

a common liquid chamber communicating with said ink flow paths and adapted to hold ink to be introduced into said ink flow paths;

electrothermal converting portions disposed in said ink flow paths and adapted to generate heat for bubbling the ink; and bubble trapping portions disposed at a communicating portion between said ink flow paths and said common liquid chamber and including stepped structures each having a cross-sectional area smaller than a main cross-sectional area of said common liquid chamber and greater than a cross-sectional area of the corresponding ink flow path in a direction perpendicular to an ink introducing direction, wherein each of said ink flow paths is provided with an inclined portion located between an upstream end of said electro thermal converting portion and the communicating portion of said ink flow path with said common liquid chamber in the ink introducing direction and having a cross-sectional area, in the direction perpendicular to the ink introducing direction, gradually increasing toward the upstream bubble trapping portion, and a surface extended from said inclined portion intersects with a ceiling surface of said bubble trapping portion, and wherein a relationship between an angle $\alpha$ between said inclined portion and a surface on which said electro thermal converting portion is located and an angle $\beta$ between a surface connecting the upstream end of said electro thermal converting portion to an upper end of said communication portion of said ink flow path and the surface on which said electro thermal converting portion is located satisfies $\beta<\alpha<\beta+10°$.

6. An ink jet recording head cartridge comprising:

a plurality of discharge ports for discharging ink droplets;

a plurality of ink flow paths communicating with the respective discharge ports;

a common liquid chamber communicating with said ink flow paths and adapted to hold ink to be introduced into said ink flow paths;

electrothermal converting portions disposed in said ink flow paths and adapted to generate heat for bubbling the ink, bubble trapping portions disposed at a communicating portion between said ink flow paths and said common liquid chamber and including stepped structures each having a cross-sectional area smaller than a main cross-sectional area of said common liquid chamber and greater than a cross-sectional area of the corresponding ink flow path in a direction perpendicular to an ink introducing direction; and wherein each of said ink flow paths is provided with an inclined portion located between an upstream end of said electro thermal converting portion and the communicating portion of said ink flow path with said common liquid chamber in the ink introducing direction and having a cross-sectional area, in the direction perpendicular to the ink introducing direction, gradually increasing toward the upstream bubble trapping portion, and a surface extended from said inclined portion intersects with a ceiling surface of said bubble trapping portion, and an ink container for holding ink to be supplied to said ink jet recording head.

7. An ink jet recording head according to claim 6, wherein said electro thermal converting portion comprises a plurality of electro thermal converting elements arranged side by side in the ink introducing direction.

8. An ink jet recording head according to claim 6, wherein said inclined portion has a restrict portion disposed at an upstream side of the upstream end of said electro thermal converting portion and at a downstream side of said inclined portion and having a narrower cross-sectional area in the direction perpendicular to the ink introducing direction.

9. An ink jet recording head according to claim 8, wherein a relationship between a cross-sectional area S1 of said ink flow path in the direction perpendicular to the ink introducing direction and a cross-sectional area S2 of the upstream end of said ink flow path in the direction perpendicular to the ink introducing direction satisfies $S1/S2 \leqq 0.5$.

10. An ink jet recording head according to claim 6, wherein a relationship between an angle $\alpha$ between said inclined portion and a surface on which said electro thermal converting portion is located and an angle $\beta$ between a surface connecting the upstream end of said electro thermal converting portion to an upper end of said communication portion of said ink flow path and the surface on which said electro thermal converting portion is located satisfies $\beta \leqq \alpha<\beta+10°$.

11. An ink jet recording apparatus having an ink jet recording head comprising:

a plurality of discharge ports for discharging ink droplets;

a plurality of ink flow paths communicating with the respective discharge ports;

a common liquid chamber communicating with said ink flow paths and adapted to hold ink to be introduced into said ink flow paths;

electrothermal converting portions disposed in said ink flow paths and adapted to generate heat for bubbling the ink; and bubble trapping portions disposed at a communicating portion between said ink flow paths and said common liquid chamber and including stepped structures each having a cross-sectional area smaller than a main cross-sectional area of said common liquid chamber and greater than a cross-sectional area of the corresponding ink flow path in a direction perpendicular to an ink introducing direction, wherein each of said ink flow paths is provided with an inclined portion located between an upstream end of said electro thermal converting portion and the communicating portion of said ink flow path with said common liquid chamber in the ink introducing direction and having a cross-sectional area, in the direction perpendicular to the ink introducing direction, gradually increasing toward the upstream bubble trapping portion, and a surface extended from said inclined portion intersects with a ceiling surface of said bubble trapping portion.

12. An ink jet recording head according to claim 11, wherein said electro thermal converting portion comprises a plurality of electro thermal converting elements arranged side by side in the ink introducing direction.

13. An ink jet recording head according to claim 11, wherein said inclined portion has a restrict portion disposed at an upstream side of the upstream end of said electro thermal converting portion and at a downstream side of said inclined portion and having a narrower cross-sectional area in the direction perpendicular to the ink introducing direction.

14. An ink jet recording head according to claim 13, wherein a relationship between a cross-sectional area S1 of said ink flow path in the direction perpendicular to the ink introducing direction and a cross-sectional area S2 of the upstream end of said ink flow path in the direction perpendicular to the ink introducing direction satisfies $S1/S2 \leqq 0.5$.

15. An ink jet recording head according to claim 11, wherein a relationship between an angle $\alpha$ between said inclined portion and a surface on which said electro thermal converting portion is located and an angle $\beta$ between a surface connecting the upstream end of said electro thermal converting portion to an upper end of said communication portion of said ink flow path and the surface on which said electro thermal converting portion is located satisfies $\beta \leqq \alpha<\beta+10°$.

* * * * *

UNITED STATES PATENT AND TRADEMARK OFFICE

CERTIFICATE OF CORRECTION

PATENT NO. : 6,402,311 B1
DATED : June 11, 2002
INVENTOR(S) : Ryoji Inoue et al.

It is certified that error appears in the above-identified patent and that said Letters Patent is hereby corrected as shown below:

Column 2,
Lines 8 and 13, “high” should read -- highly --;
Line 40, “case” should read -- the case --;
Line 41, “head” should read -- head in which --;
Line 58, “bobbles” should read -- bubbles --;
Line 63, “was” should read -- were --.

Column 3,
Line 15, “remained” should read -- remaining --;
Line 41, “affecting” should read -- effecting --.

Column 4,
Line 21, “solve” should read -- solves --.

Column 6,
Line 11, “form” should read -- from --.

Column 8,
Line 18, “to” should be deleted;
Line 45, “of” should be deleted.

Column 9,
Line 25, “can be remained” should read -- can remain --;
Line 43, “remained” should read -- remaining --.

Column 10,
Line 36, “remained” should read -- remaining --;
Line 38, “be remained” should read -- remain --;
Line 41, “solved” should read -- dissolved --;
Line 58, “is” should read -- are --.

Column 11,
Lines 12, 23 and 37, “a” should read -- α --;
Line 55, “be remained.” should read -- remain. --.

UNITED STATES PATENT AND TRADEMARK OFFICE

CERTIFICATE OF CORRECTION

PATENT NO. : 6,402,311 B1
DATED : June 11, 2002
INVENTOR(S) : Ryoji Inoue et al.

It is certified that error appears in the above-identified patent and that said Letters Patent is hereby corrected as shown below:

Column 12,
Line 55, “312,” should read -- holes 312, --.

Column 13,
Line 47, “poring” should read -- pouring --;
Line 62, “to” should be deleted.

Column 14,
Line 18, “paced” should read -- spaced --;
Line 37, “uniformed” should read -- uniformly --.

Column 15,
Line 12, “in syn-” should read -- synchronously --;
Line 13, “chronous” should be deleted;
Line 41, “lover” should read -- lever --.

Column 16,
Line 11, “the data,” should read -- to the data, --.

Column 17,
Line 2, “maintenance of” should read -- maintain --;
Line 33, “process” should read -- process is carried out --;
Line 38, “adjust” should read -- adjusting --;
Line 44, “remained” should read -- remaining --.

Column 18,
Lines 52 and 66, “electro thermal” should read -- electrothermal --;
Line 63, “electro” should read -- electro- --.

Column 19,
Lines 1, 24, 36, 37, 41, 53, 55 and 58, “electro thermal” should read -- electrothermal --;
Line 2, “$\beta < \alpha < \beta + 10^{\circ}$.” should read -- $\beta \leq \alpha < \beta + 10^{\circ}$. --.

UNITED STATES PATENT AND TRADEMARK OFFICE

CERTIFICATE OF CORRECTION

PATENT NO. : 6,402,311 B1
DATED : June 11, 2002
INVENTOR(S) : Ryoji Inoue et al.

It is certified that error appears in the above-identified patent and that said Letters Patent is hereby corrected as shown below:

Column 20,
Lines 23, 33, 34, 51, 53 and 55, “electro thermal” should read -- eletrothermal --;
Line 38, “electro” should read -- electro- --.

Signed and Sealed this

Twenty-eighth Day of January, 2003

JAMES E. ROGAN
*Director of the United States Patent and Trademark Office*